US008292295B2

(12) United States Patent
Ohshima et al.

(10) Patent No.: US 8,292,295 B2
(45) Date of Patent: Oct. 23, 2012

(54) SHEET MEASURING APPARATUS AND IMAGE FORMING APPARATUS

(75) Inventors: Minoru Ohshima, Kanagawa (JP); Michio Taniwaki, Kanagawa (JP)

(73) Assignee: Fuji Xerox, Co., Ltd., Tokyo (JP)

( * ) Notice: Subject to any disclaimer, the term of this patent is extended or adjusted under 35 U.S.C. 154(b) by 0 days.

(21) Appl. No.: 13/091,815

(22) Filed: Apr. 21, 2011

(65) Prior Publication Data

US 2012/0139180 A1 Jun. 7, 2012

(30) Foreign Application Priority Data

Dec. 7, 2010 (JP) ..... 2010-272524

(51) Int. Cl.
*B65H 7/02* (2006.01)

(52) U.S. Cl. ..... 271/265.01; 271/265.02

(58) Field of Classification Search ..... 271/258.01, 271/259, 265.01, 265.02; 358/1.12
See application file for complete search history.

(56) References Cited

U.S. PATENT DOCUMENTS

| | | | | |
|---|---|---|---|---|
| 7,007,945 | B2 * | 3/2006 | Hiramitsu et al. | 271/125 |
| 7,597,322 | B2 * | 10/2009 | Suzuki et al. | 271/265.02 |
| 7,871,073 | B2 * | 1/2011 | Noguchi et al. | 271/265.01 |
| 7,971,878 | B2 * | 7/2011 | Hashimoto et al. | 271/274 |
| 2008/0232880 | A1 * | 9/2008 | Noguchi et al. | 399/397 |
| 2009/0212491 | A1 * | 8/2009 | Noguchi et al. | 271/265.04 |
| 2011/0176158 | A1 * | 7/2011 | Furuya et al. | 358/1.12 |
| 2012/0076563 | A1 * | 3/2012 | De Monet et al. | 400/582 |

FOREIGN PATENT DOCUMENTS

| | | |
|---|---|---|
| JP | A 8-225239 | 9/1996 |
| JP | A 2000-238356 | 9/2000 |
| JP | A 2003-171035 | 6/2003 |
| JP | A 2006-254550 | 9/2006 |
| JP | A 2009-256105 | 11/2009 |

* cited by examiner

*Primary Examiner* — Kaitlin Joerger
(74) *Attorney, Agent, or Firm* — Oliff & Berridge, PLC

(57) ABSTRACT

A sheet measuring apparatus includes a first rotating member that includes a first peripheral surface portion that contacts a transported sheet; a second rotating member that includes a second peripheral surface portion made of a material different from that of the first peripheral surface portion, the second peripheral surface contacting the first peripheral surface portion and not contacting the sheet; a first rotation amount detecting unit that detects a first rotation amount that is a rotation amount of the first rotating member; a second rotation amount detecting unit that detects a second rotation amount that is a rotation amount of the second rotating member, the second rotation amount being used for a calculation related to the transported sheet; and a fault detecting unit that detects a fault that has occurred in the first rotating member on the basis of the first rotation amount and the second rotation amount.

16 Claims, 15 Drawing Sheets

SHEET MEASURING APPARATUS AND IMAGE FORMING APPARATUS

CROSS-REFERENCE TO RELATED APPLICATIONS

This application is based on and claims priority under 35 USC 119 from Japanese Patent Application No. 2010-272524 filed Dec. 7, 2010.

BACKGROUND

Technical Field

The present invention relates to a sheet measuring apparatus and an image forming apparatus.

SUMMARY

According to an aspect of the invention, a sheet measuring apparatus includes a first rotating member that includes a first peripheral surface portion that contacts a transported sheet, the first rotating member being rotated as a result of transporting of the sheet; a second rotating member that includes a second peripheral surface portion that is made of a material different from a material of the first peripheral surface portion, the second peripheral surface contacting the first peripheral surface portion and not contacting the sheet, the second rotating member rotating as the first rotating member rotates; a first rotation amount detecting unit that detects a first rotation amount that is a rotation amount of the first rotating member; a second rotation amount detecting unit that detects a second rotation amount that is a rotation amount of the second rotating member, the second rotation amount being used for a calculation related to the transported sheet; and a fault detecting unit that detects a fault that has occurred in the first rotating member on the basis of the first rotation amount and the second rotation amount.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the present invention will be described with reference to the drawings.

Figure 1:
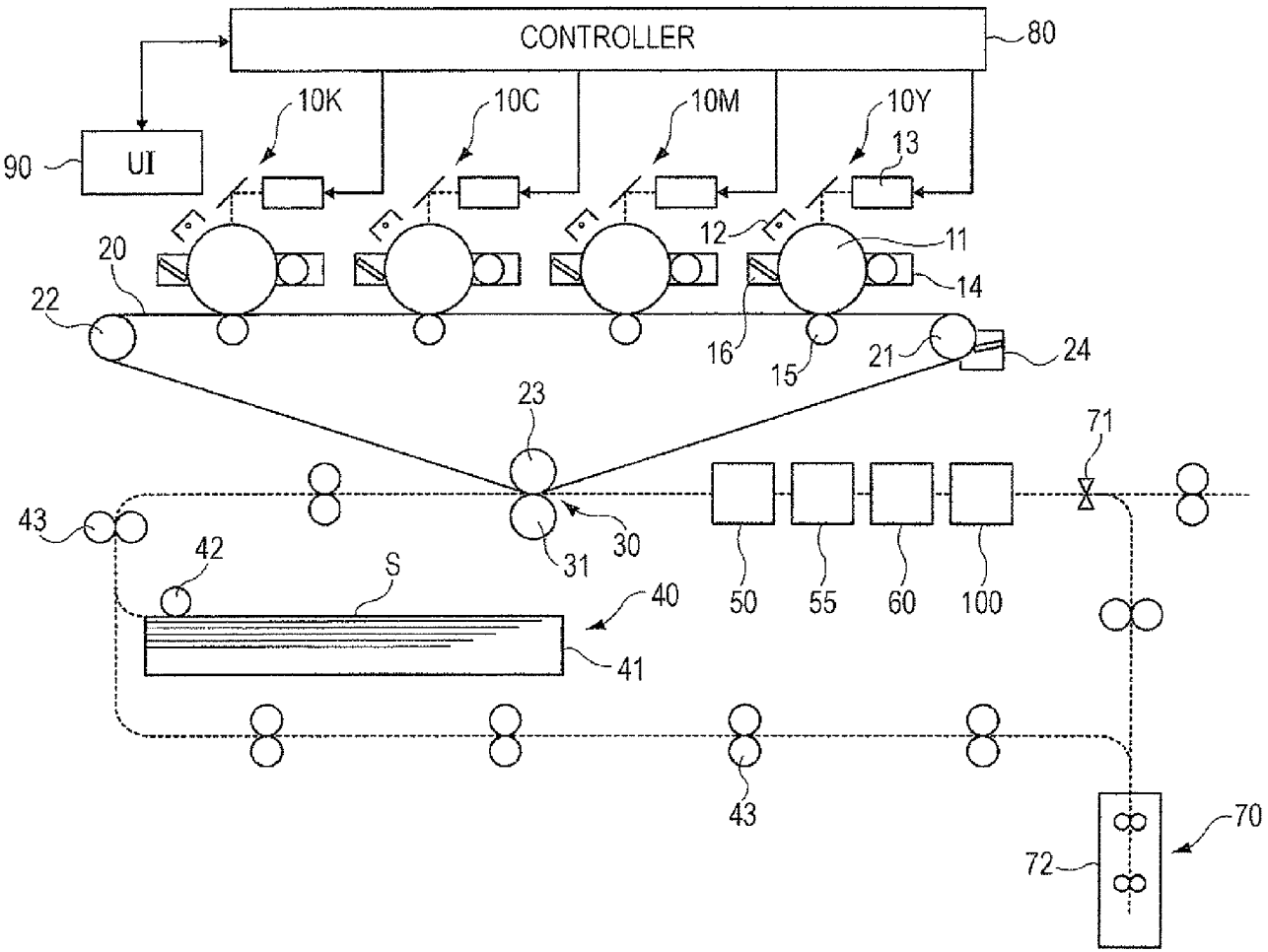
FIG. 1 is a schematic view of an image forming apparatus according to an exemplary embodiment of the present invention.

FIG. 1 is a schematic view of an image forming apparatus according to the exemplary embodiment. The image forming apparatus illustrated in FIG. 1 has a so-called tandem structure, and includes plural image forming units 10 (10Y, 10M, 10C, 10K) that form color toner images by using, for example, an electrophotographic method. The image forming apparatus includes an intermediate transfer belt 20 and a second-transfer device 30. The color toner images formed by the image forming units 10 are successively transferred (first-transferred) onto the intermediate transfer belt 20. The second-transfer device 30 simultaneously transfers (second-transfers) the superposed images, which have been transferred to the intermediate transfer belt 20, onto the sheet S. The image forming apparatus includes a sheet feeder 40, a fixing device 50, a cooling device 55, and a decurler 60. The sheet feeder 40 feeds the sheet S toward the second-transfer device 30. The fixing device 50 heats the image, which has been second-transferred to the second-transfer device 30, and thermally fixes the image onto the sheet S. The cooling device 55 cools the image formed on the sheet S. The decurler 60 corrects a curl of the sheet S that is generated when the sheet S is cooled. In the present exemplary embodiment, the image forming units 10, the intermediate transfer belt 20, and the second-transfer device 30 function as an image forming unit.

Each of the image forming units 10 includes a photoconductor drum 11, a charging device 12, an exposure device 13, a developing device 14, a first-transfer device 15, and a drum cleaner 16. The photoconductor drum 11 is rotatable. The charging device 12 is disposed near the photoconductor drum 11 and charges the photoconductor drum 11. The exposure device 13 exposes the photoconductor drum 11 to light and forms an electrostatic latent image. The developing device 14 makes the electrostatic latent image visible by using toner. The first-transfer device 15 transfers color toner images from the photoconductor drum 11 onto the intermediate transfer belt 20. The drum cleaner 16 removes residual toner from the photoconductor drum 11. In the following description, the image forming units 10 will be respectively referred to as a yellow image forming unit 10Y, a magenta image forming unit 10M, a cyan image forming unit 10C, and a black image forming unit 10K.

The intermediate transfer belt 20 is looped over three rollers 21 to 23 and rotates. The roller 22 drives the intermediate transfer belt 20. The roller 23 is disposed opposite a second-transfer roller 31 with the intermediate transfer belt 20 therebetween. The second-transfer roller 31 and the roller 23 constitute the second-transfer device 30. A belt cleaner 24 is disposed opposite the roller 21 with the intermediate transfer belt 20 therebetween. The belt cleaner 24 removes residual toner from the intermediate transfer belt 20.

The sheet feeder 40 includes a sheet container 41 and a pick-up roller 42. The sheet container 41 holds the sheet S. The pick-up roller 42 picks up the sheet S from the sheet container 41 and transports the sheet S. Plural transport rollers 43 are disposed in the transport path along which the sheet S is transported from the sheet feeder 40. The sheet S may be made of any of a paper sheet, a resin sheet that is used for an OHP sheet or the like, and a paper sheet coated with a resin.

The fixing device 50 includes a heater for heating the sheet S. In the present exemplary embodiment, the fixing device 50 heats and presses the image, which has been transferred to the sheet S, and thereby fixes the image.

The cooling device 55 has a function of cooling the sheet S, which has been heated by the fixing device 50. The cooling device 55 may be, for example, configured so that the sheet S passes between two metal rollers while being nipped by the metal rollers.

The decurler 60 has a function of correcting a curl (warping) that is generated in the sheet S.

The image forming apparatus according to the present exemplary embodiment is not only capable of forming an image on one side of the sheet S that is fed from the sheet feeder 40, but also capable of forming an image on the other side of the sheet S by reversely transporting the one-side recorded sheet S. To perform this function, the image forming apparatus includes a reverse-transport mechanism 70. After the sheet S has passed through the fixing device 50, the cooling device 55, and the decurler 60, the reverse-transport mechanism 70 flips the sheet S over and reverses the transport direction of the sheet S and returns the sheet S to the second-transfer device 30. The reverse-transport mechanism 70 is disposed downstream of the decurler 60 in the transport direction of the sheet S. The reversing mechanism includes a switching device 71 that switches the transport path of the sheet S between a path for outputting the sheet S to the outside of the image forming apparatus and a path for reversely transporting the sheet S. The reverse-transport mechanism 70 further includes a reversing device 72 that is disposed in the transport path for reversely transporting the sheet S. The reversing device 72 reverses the transport direction of the sheet S and flips the sheet S over before the sheet S is transported to the second-transfer device 30 again. Plural transport rollers 43 are disposed in the transport path for reversely transporting the sheet S.

The image forming apparatus according to the present exemplary embodiment further includes a length measuring device 100 that is disposed downstream of the decurler 60 in the transport direction of the sheet S and upstream of the switching device 71 in the transport direction of the sheet S. The length measuring device 100 measures the length of the sheet S that is transported thereto. The length measuring device 100 need not be disposed at the above-described position, and may be disposed in the transport path for reversely transporting the sheet S.

The image forming apparatus further includes a controller 80 and a user interface (UI) 90. The controller 80 controls the devices and units of the image forming apparatus. The user interface (UI) 90 outputs an instruction received from a user to the controller 80 and provides the user with an instruction received from the controller 80 by using a screen (not shown) or the like.

Figure 2A:
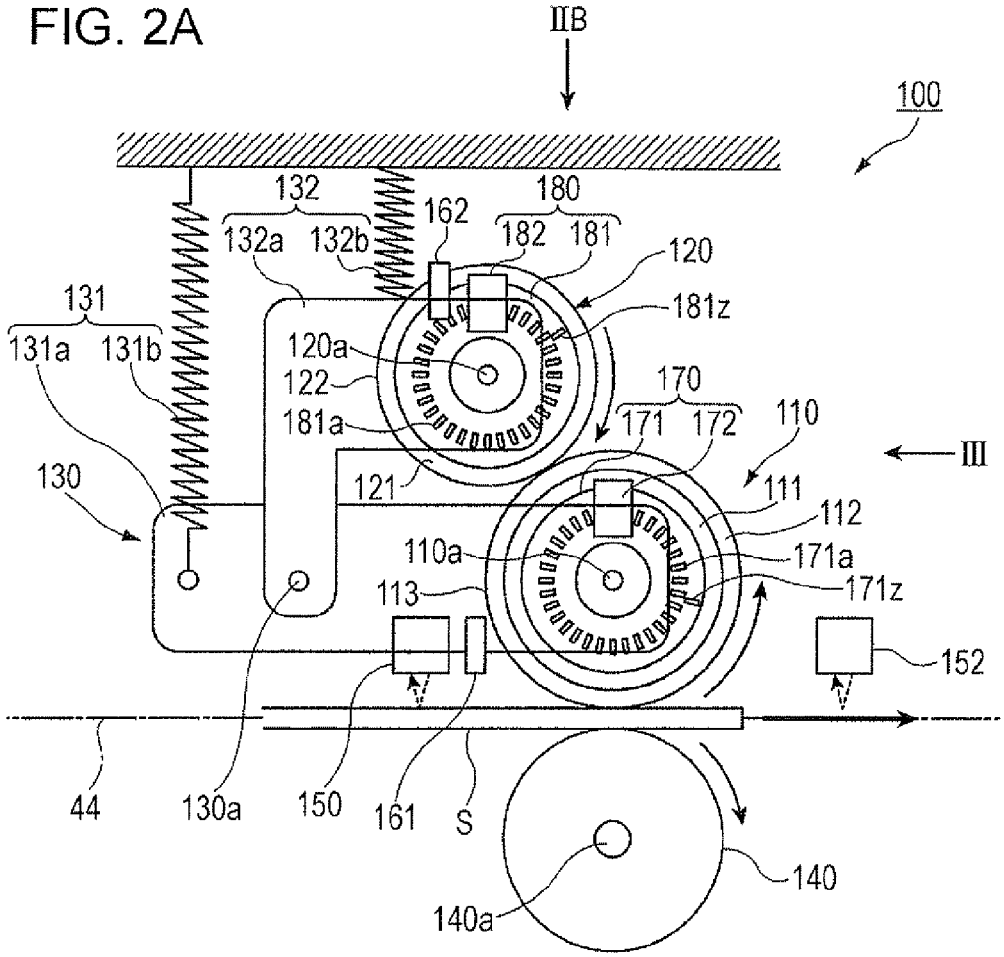
FIG. 2A is a side view of a length measuring device seen from the front side of the image forming apparatus.
Figure 2B:
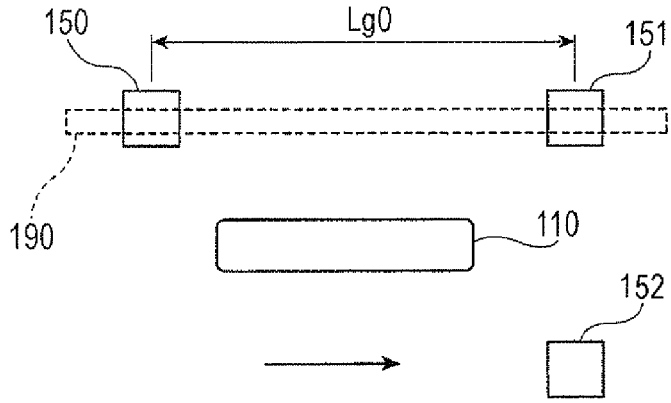
FIG. 2B is a top view of the length measuring device seen in the direction IIB of FIG. 2A.
Figure 3:
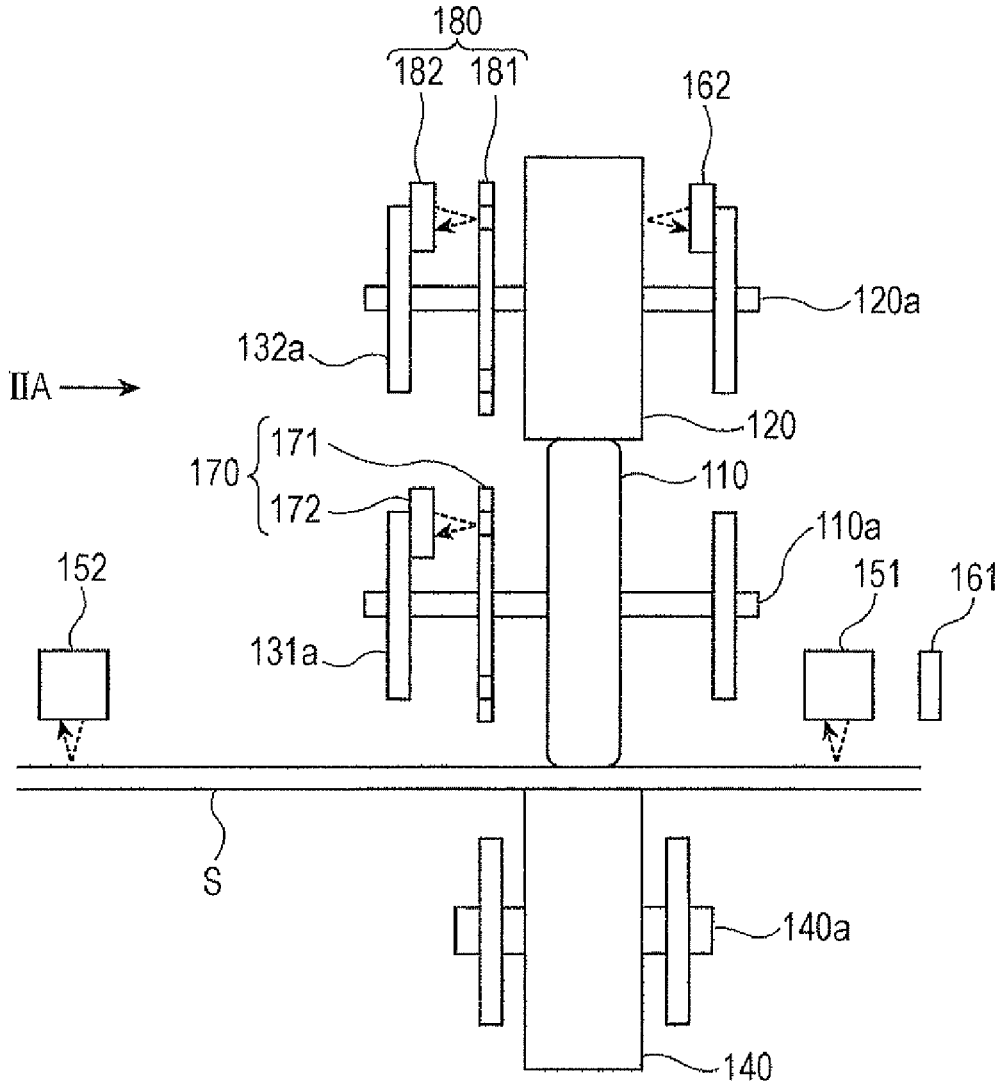
FIG. 3 is a front view of the length measuring device seen in the direction III of FIG. 2A (from the downstream side in the sheet transport direction)

FIGS. 2 and 3 illustrate the length measuring device 100 included in the image forming apparatus illustrated in FIG. 1. FIG. 2A is a side view of the length measuring device 100 seen from the front side (see FIG. 1) of the image forming apparatus, and FIG. 2B is a top view of the length measuring device 100 seen in the direction IIB of FIG. 2A. FIG. 3 is a front view of the length measuring device seen in the direction III of FIG. 2A (from the downstream side in the transport direction of the sheet S).

The length measuring device 100 includes a first roller 110, a second roller 120, a support mechanism 130, and a third roller 140. The first roller 110 is disposed above a transport path 44 and rotates around a first rotation shaft 110*a*. The second roller 120 is disposed above the first roller 110, is in contact with the first roller 110, and rotates around a second rotation shaft 120*a*. The support mechanism 130 supports the first roller 110 and the second roller 120. The third roller 140 is disposed opposite the first roller 110 with the transport path 44 therebetween, and rotates around a third rotation axis 140*a*. The length measuring device 100 includes a first rotation amount sensor 170 and a second rotation amount sensor 180. The first rotation amount sensor 170 detects the rotation count and the rotation amount of the first roller 110. The second rotation amount sensor 180 detects the rotation count and the rotation amount of the second roller 120.

The first roller 110, which is an example of a first rotating member, includes a first-roller body 111 and a surface layer 112. The first-roller body 111 is disposed so as to surround the first rotation shaft 110*a*. The surface layer 112 is formed on an outer peripheral surface of the first-roller body 111. The outer peripheral surface of the first roller 110 is a first peripheral surface portion 113 that is a part of the surface layer 112. In the present exemplary embodiment, the first-roller body 111 and the surface layer 112 are both made of an elastic material such as a rubber or the like. The hardness of the surface layer 112 is larger than that of the first-roller body 111. In this example, the first roller 110 has two layers. However, the first roller 110 may have only one layer or three or more layers. The first-roller body 111 and the surface layer 112 may be made of a material other than a rubber, such as a plastic, or may be made of different materials. The first-roller body 111 may be made of, for example, a metal such as aluminum.

The second roller 120, which is an example of a second rotating member, includes a second-roller body 121. The second-roller body 121 is disposed so as to surround the second rotation shaft 120*a*, and the entirety of the second-roller body 121, including the outer peripheral surface, is made of a metal such as aluminum. The outer peripheral surface of the second roller 120 is a second peripheral surface 122 that is a part of the second-roller body 121.

Thus, in the present exemplary embodiment, the first peripheral surface portion 113 of the first roller 110, which contacts the transported sheet S, is made of a rubber that has a friction coefficient higher than that of a metal. The second peripheral surface 122 of the second roller 120, which contacts the first peripheral surface portion 113 of the first roller 110, is made of a metal that has a thermal expansion coefficient smaller than that of a rubber.

The support mechanism 130 includes a support shaft 130*a*, a first arm 131*a*, and a second arm 132*a*. The support shaft 130*a* is disposed upstream of the first roller 110 in the transport direction of the sheet S and above the transport path 44, and extends parallelly to the first rotation shaft 110*a* and the second rotation shaft 120*a*. The first arm 131*a* and the second arm 132*a* are rotatable around the support shaft 130*a*. The support shaft 130*a* is fixed to and supported by the housing (not shown) of the length measuring device 100.

The first arm 131*a* extends in the transport direction of the sheet S. The support shaft 130*a* is attached to a midstream part of the first arm 131*a* in the transport direction of the sheet S. The first rotation shaft 110*a* of the first roller 110 is rotatably attached to the downstream end of the first arm 131*a* in the transport direction of the sheet S. A through-hole is formed in an end portion of the first arm 131*a* that is located upstream of the support shaft 130*a* in the transport direction of the sheet S. One end of a first spring 131*b* is attached to the through-hole. The first spring 131*b* is a tension spring that extends upward. The other end of the first spring 131*b* is attached to the housing of the length measuring device 100. Thus, the first spring 131*b* applies to the first arm 131*a* a force that is directed clockwise around the support shaft 130*a* in FIG. 2A. As a result, the first roller 110 is pressed against the third roller 140 (toward the transport path 44). Both the first arm 131*a* and the first spring 131*b* are disposed at each end of the first roller 110 in the axial direction. In the present exemplary embodiment, the first arm 131*a* and the first spring 131*b* constitute a first support portion 131 that supports the first roller 110.

The second arm 132*a* has an L-shape that extends upward from a first end that is in a lower part thereof and then extends downstream in the transport direction of the sheet S. The support shaft 130*a* is attached to the first end of the second arm 132*a*. The second rotation shaft 120*a* of the second roller 120 is rotatably attached to a second end of the second arm 132*a*, which is located above the first end and downstream of the first end in the transport direction of the sheet S. One end of a second spring 132*b* is attached to an upper end of the second arm 132*a*. The second spring 132*b* is a compression spring that extends upward. The other end of the second spring 132*b* is attached to the housing of the length measuring device 100. Thus, the second spring 132*b* applies to the second arm 132*a* a force that is directed clockwise around the support shaft 130*a* in FIG. 2A. As a result, the second roller 120 is pressed against the first roller 110. Both the second arm 132*a* and the second spring 132*b* are disposed at each end of the second roller 120 in the axial direction. In the present exemplary embodiment, the second arm 132*a* and second spring 132*b* constitute a second support portion 132 that supports the second roller 120.

The third roller 140, including the outer peripheral surface thereof, is made of a metal such as aluminum. When the sheet S is present between the third roller 140 and the first roller 110, the third roller 140 contacts the sheet S. If not, the third roller 140 contacts the first roller 110. In the present exemplary embodiment, the third roller 140 is disposed opposite the first roller 110 with the transport path 44 therebetween. Instead of the third roller 140, a fixed member, such as a metal plate, may be used.

The length measuring device 100 includes an upstream sensor 150, a first downstream sensor 151, and a second downstream sensor 152. The upstream sensor 150 is disposed upstream, in the transport direction of the sheet S, of a position at which the first roller 110 contacts the sheet S (or the third roller 140), and detects passing of the leading end and the trailing end of the sheet S. The first downstream sensor 151 and the second downstream sensor 152 are disposed downstream, in the transport direction of the sheet S, of a position at which the first roller 110 contacts the sheet S (or the third roller 140), and detects passing of the leading end and the trailing end of the sheet S. In the present exemplary embodiment, each of the upstream sensor 150, the first downstream sensor 151, and the second downstream sensor 152 is a photoelectric sensor including a light emitting diode (LED) and a photosensor, and optically detects the transported sheet S that is passing an opposite position. The upstream sensor 150, the first downstream sensor 151, and the second downstream sensor 152 are attached to the housing (not shown) of the length measuring device 100.

In particular, the upstream sensor 150 and the first downstream sensor 151 are attached to an attachment member 190 that extends in the transport direction of the sheet S. As a result, the upstream sensor 150 and the first downstream sensor 151 are disposed on a straight line extending in the transport direction of the sheet S. The first downstream sensor 151 and the second downstream sensor 152 are disposed opposite each other in a direction perpendicular to the transport direction of the sheet S with a position at which the sheet S contacts the first roller 110 therebetween. In the following description, the term "reference gap length Lg0" refers to the distance between the detection position of the upstream sensor 150 and the detection position of the first downstream sensor 151 at a reference temperature. In the present exemplary embodiment, the upstream sensor 150, the first downstream sensor 151, and the second downstream sensor 152 function as an end detecting unit.

The length measuring device 100 includes a first temperature sensor 161 and a second temperature sensor 162. The first temperature sensor 161 measures the ambient temperature around the attachment member 190. The second temperature sensor 162, which is an example of a temperature detecting unit, detects the ambient temperature around the second roller 120. The first temperature sensor 161 is attached to the housing (not shown) of the length measuring device 100. The second temperature sensor 162 is attached to the second arm 132*a* of the support mechanism 130. The first temperature sensor 161 and the second temperature sensor 162 may measure, in addition to the ambient temperature, the surface temperatures of the attachment member 190 and the second roller 120, or may measure the internal temperatures of the attachment member 190 and the second roller 120. In the present exemplary embodiment, the sheet S that has been heated by the fixing device 50 passes through the length measuring device 100. Therefore, as an increasing number of sheets S pass through the length measuring device 100, the internal temperature of the length measuring device 100 may increase. In this example, after the sheet S has passed through the fixing device 50 and the cooling device 55, the sheet S reaches the length measuring device 100. If the sheet S has not been sufficiently cooled, the sheet S that retains heat may enter the length measuring device 100.

The first rotation amount sensor 170, which is an example of a first rotation amount detecting unit, includes a first encoder wheel 171 and a first optical detector 172. The first encoder wheel 171 has a disk-like shape, is attached to the first rotation shaft 110*a* of the first roller 110, and rotates together with the first roller 110. The first optical detector 172 is attached to the first arm 131*a* of the support mechanism 130 so as to face a side surface of the first encoder wheel 171. Plural first A-phase slits 171*a* and a first Z-phase slit 171*z* extend through the sides (front and back sides) of the first encoder wheel 171. The first A-phase slits 171*a* are disposed at regular intervals in the circumferential direction. The first Z-phase slit 171*z* is formed at a position that is outside the first A-phase slits 171*a* in the radial direction. The first optical detector 172 optically detects passing of the first A-phase slits 171*a* and passing of the first Z-phase slit 171*z* when the first encoder wheel 171 rotates together with the first roller 110. In this example, n first A-phase slits 171*a* are formed in the first encoder wheel 171.

The second rotation amount sensor 180, which is an example of a second rotation amount detecting unit, includes a second encoder wheel 181 and a second optical detector 182. The second encoder wheel 181 has a disk-like shape, is attached to the second rotation shaft 120*a* of the second roller 120, and rotates together with the second roller 120. The second optical detector 182 is attached to the second arm 132*a* of the support mechanism 130 so as to face a side surface of the second encoder wheel 181. Plural second A-phase slits 181*a* and a second Z-phase slit 181*z* extend through the sides (front and back sides) of the second encoder wheel 181. The second A-phase slits 181*a* are disposed at regular intervals in the circumferential direction. The second Z-phase slit 181*z* is formed at a position that is outside the second A-phase slits 181*a* in the radial direction. The second optical detector 182 optically detects passing of the second A-phase slits 181*a* and passing of the second Z-phase slit 181*z* when the second encoder wheel 181 rotates together with the second roller 120. In this example, m second A-phase slits 181*a* are formed in the second encoder wheel 181.

In the present exemplary embodiment, each of the first rotation amount sensor 170 and the second rotation amount sensor 180 is an incremental rotary encoder. However, any type of sensor may be used, as long as the sensor is capable of measuring the rotation amount of a roller smaller than one rotation ($2\pi$(rad)). In the present exemplary embodiment, the first rotation amount sensor 170 and the second rotation amount sensor 180 are sensors that utilize variation in the amount of light. However, the sensors may be sensors that utilize, for example, magnetic variation.

Figure 4:
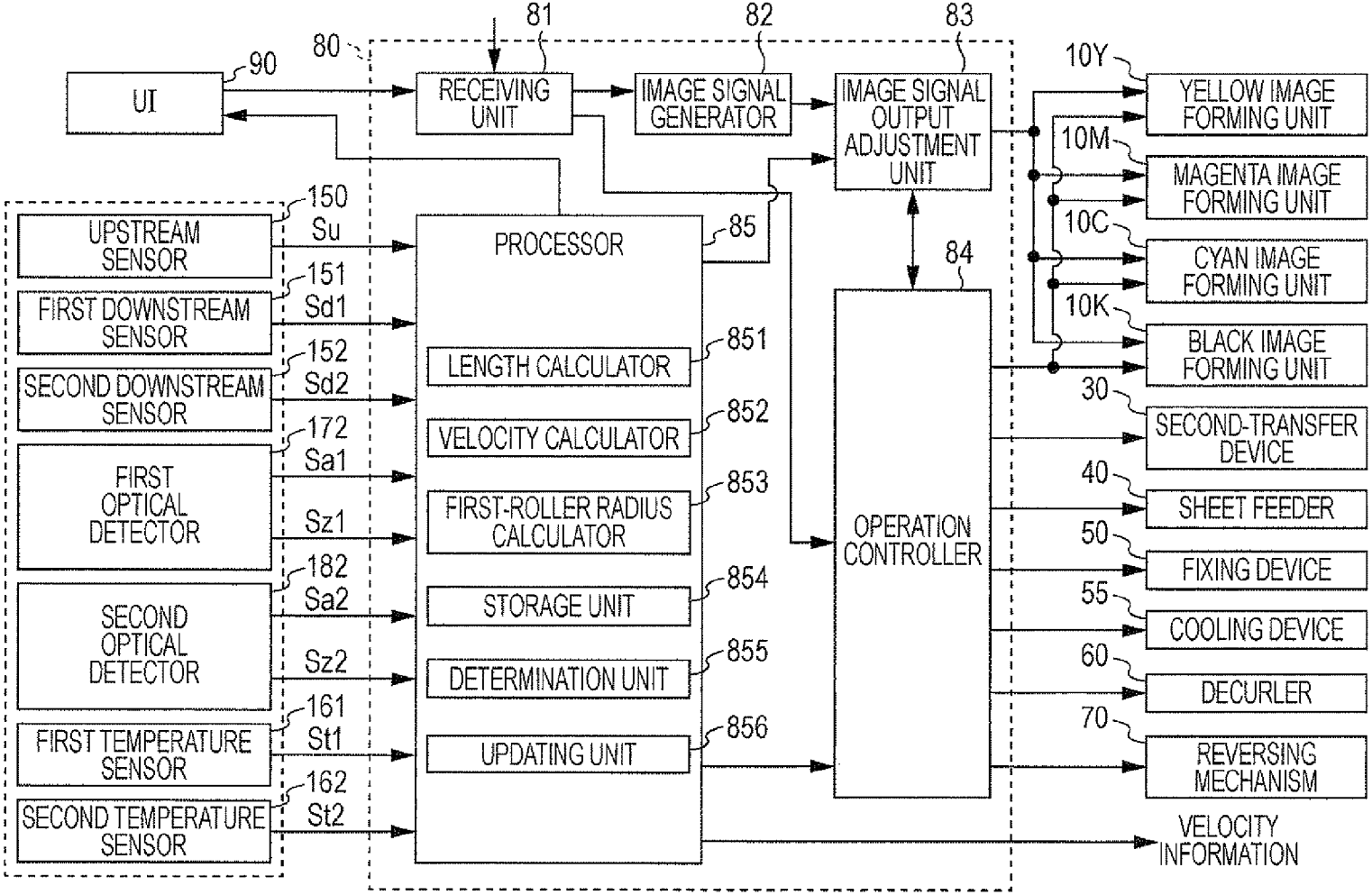
FIG. 4 is a block diagram of a controller.

FIG. 4 is a block diagram of the controller 80 illustrated in FIG. 1.

The controller 80 includes a receiving unit 81 and an image signal generator 82. The receiving unit 81 receives instruction sent from the UI 90 or an external apparatus (not shown) that is connected to the image forming apparatus. When a print instruction is received by the receiving unit 81, the image signal generator 82 generates color image signals for yellow, magenta, cyan, and black on the basis of image data that has been sent together with the print instruction. The controller 80 includes an image signal output adjustment unit 83 that adjusts timing for outputting the color image signals, which have been generated by the image signal generator 82, to the image forming units 10 (to be specific, the exposure devices 13 of the image forming units 10). Moreover, the image signal output adjustment unit 83 adjusts the magnifications of the color image signals, which have been generated by the image signal generator 82, in the sub-scanning direction (corresponding to the transport direction of the sheet S). The controller 80 includes an operation controller 84 that controls operations of the units and devices of the image forming apparatus, including the image forming units 10 (10Y, 10M, 10C, 10K), the second-transfer device 30, the sheet feeder 40, the fixing device 50, the cooling device 55, the decurler 60, and the reverse-transport mechanism 70.

The controller 80 according to the present exemplary embodiment includes a processor 85 that performs various calculations on the basis of various signals that are input from the length measuring device 100. The processor 85 includes a length calculator 851, a velocity calculator 852, a first-roller radius calculator 853, a storage unit 854, a determination unit 855, and an updating unit 856. The length calculator 851 calculates a sheet length L that is the length of the sheet S in the transport direction, the sheet S passing through the length measuring device 100. The velocity calculator 852 calculates a sheet velocity V that is the transport velocity of the sheet S. The first-roller radius calculator 853 calculates the radius of the first roller 110 when the sheet S passes. The storage unit 854 stores various data that is used in the calculations performed by the length calculator 851, the velocity calculator 852, and the first-roller radius calculator 853. The determination unit 855 determines whether or not the first roller 110 has reached the end of its lifetime on the basis of a calculation result obtained by the first-roller radius calculator 853. The updating unit 856 updates a part of data stored in the storage unit 854 on the basis of the calculation result obtained by the first-roller radius calculator 853. In the present exemplary embodiment, the length calculator 851 and the velocity calculator 852 are an example of a sheet calculating unit, the first-roller radius calculator 853 is an example of a radius distribution calculating unit, the determination unit 855 is an example of a fault detecting unit, and the updating unit 856 is an example of an updating unit.

An upstream edge signal Su that is output from the upstream sensor 150, a first downstream edge signal Sd1 that is output from the first downstream sensor 151, and a second downstream edge signal Sd2 that is output from the second downstream sensor 152 are input to the processor 85. A first A-phase signal Sa1 and a first Z-phase signal Sz1 that are output from the first optical detector 172 of the first rotation amount sensor 170 are input to the processor 85. The first A-phase signal Sa1 is a signal indicating detection of the first A-phase slits 171*a*. The first Z-phase signal Sz1 is a signal indicating detection of the first Z-phase slit 171*z*. A second A-phase signal Sa2 and a second Z-phase signal Sz2 that are output from the second optical detector 182 of the second rotation amount sensor 180 are input to the processor 85. The second A-phase signal Sa2 is a signal indicating detection of the second A-phase slits 181*a*. The second Z-phase signal Sz2 is a signal indicating detection of the second Z-phase slit 181*z*. A first temperature signal St1 that is output from the first temperature sensor 161 and a second temperature signal St2 that is output from the second temperature sensor 162 are input to the processor 85.

The sheet length L, which has been calculated by the length calculator 851, is output to the image signal output adjustment unit 83, and is used to adjust the output of an image signal. The sheet length L is also output to the operation controller 84, and is used to control the operations of the units and devices included the image forming apparatus. The sheet velocity V (velocity information), which has been calculated by the velocity calculator 852, is output to the outside and used for performing various operations.

The controller 80 includes a central processing unit (CPU), a read only memory (ROM), and a random access memory (RAM). The CPU performs processing on the basis of a program stored in the ROM while exchanging data with the RAM.

Figure 5:
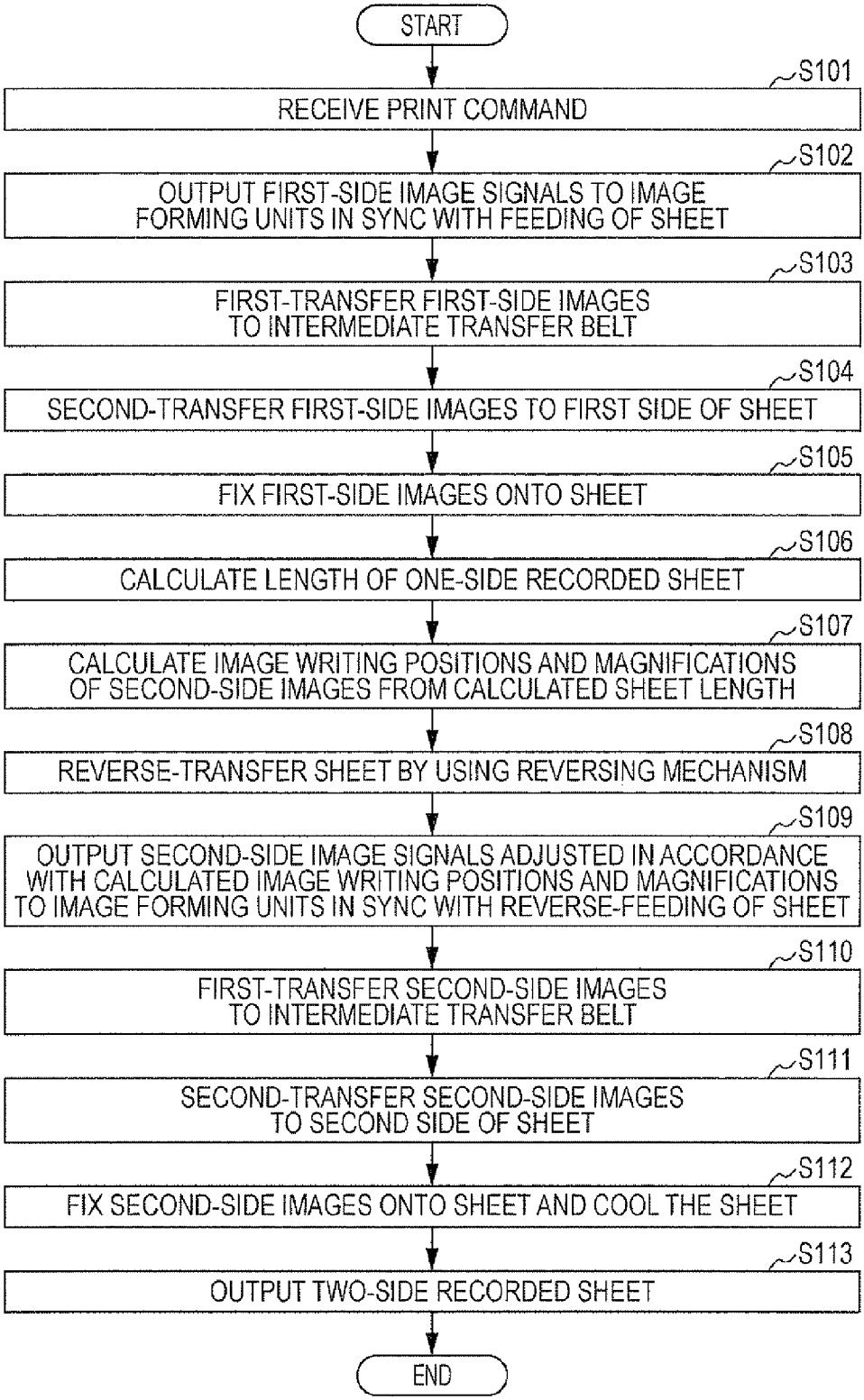
FIG. 5 is a flowchart illustrating a process performed by the controller when forming images on both sides of a sheet.

FIG. 5 is a flowchart illustrating a process performed by the controller 80 when the image forming apparatus illustrated in FIG. 1 forms images on both sides of the sheet S. Referring to FIGS. 1 to 5, the process will be described.

When the receiving unit 81 receives a print command from the UI 90 or an external apparatus (step S101), the operation controller 84 activates the units and devices included in the image forming apparatus and causes the units and devices to perform warm-up operations, and the image signal generator 82 generates image signals for color images to be formed on a first side of the sheet S on the basis of input image data. Next, the operation controller 84 causes the sheet feeder 40 to feed the sheet S, and the image signal output adjustment unit 83 outputs the image signals for color images, which have been generated by the image signal generator 82, to the image forming units 10 (to be specific, the exposure devices 13 of the image forming units 10) in sync with feeding of the sheet S (step S102).

Thus, the image forming units 10 form images (in this example, toner images) in accordance with the image signals for the first side. To be specific, the operation controller 84 causes the photoconductor drums 11 of the image forming units 10 to rotate, causes the charging devices 12 to charge the rotating photoconductor drums 11, causes the exposure devices 13 to expose the photoconductor drums 11 with light beams that are emitted in accordance with the color image signals for the first side, thereby forming electrostatic latent images on the surfaces of the photoconductor drums 11. Next, the operation controller 84 causes the developing devices 14 to develop the electrostatic latent images formed on the photoconductor drums 11 for the corresponding colors, thereby forming color images for the first side. The operation controller 84 causes the first-transfer device 15 to successively first-transfer the images for the first side from the photoconductor drums 11 to the rotating intermediate transfer belt 20 (step S103). Thus, the images for the first side are first-transferred to the intermediate transfer belt 20 in an overlapping manner, and when the intermediate transfer belt 20 rotates further, the images are moved to the second-transfer position in the second-transfer device 30 at which the second-transfer roller 31 and the roller 23 are disposed opposite each other.

The sheet S, which has been fed by the sheet feeder 40, is transported by the transport rollers 43 and reaches the second-transfer position. Then, the operation controller 84 causes the second-transfer device 30 to second-transfer the images for the first side from the intermediate transfer belt 20 to the first side of the sheet S (step S104).

Next, the operation controller 84 causes the fixing device 50 to fix the images, which have been transferred to the first side of the sheet S, by, for example, heating and pressing the sheet S. The operation controller causes the cooling device 55 to cool the sheet S, which has been heated by the fixing device 50 (step S105). The sheet S passes through the cooling device 55, is decurled by the decurler 60, and is further transported.

After the sheet S, on which the image have been fixed on the first side thereof, passes through the cooling device 55 and the decurler 60, the one-side recorded sheet S is further transported to the length measuring device 100. In the length measuring device 100, the first roller 110 and the second roller 120 rotate as the one-side recorded sheet S is transported. The first optical detector 172 of the first rotation amount sensor 170 outputs the first A-phase signal Sa1 and the first Z-phase signal Sz1 in accordance with the rotation amount of the first roller 110. The second optical detector 182 of the second rotation amount sensor 180 outputs the second A-phase signal Sa2 and the second Z-phase signal Sz2 in accordance with the rotation amount of the second roller 120. The upstream sensor 150 outputs the upstream edge signal Su, the first downstream sensor 151 outputs the first downstream edge signal Sd1, and the second downstream sensor 152 outputs the second downstream edge signal Sd2.

The signals output from the length measuring device 100 are input to the processor 85. The length calculator 851 of the processor 85 calculates the sheet length L of the one-side recorded sheet S, which has passed through the length measuring device 100, by using the signals input from the length measuring device 100 and data for calculation stored in the storage unit 854 (step S106). Subsequently, the length calculator 851 outputs the calculated sheet length L to the image signal output adjustment unit 83 and the operation controller 84. Specific calculations performed by the length calculator 851 will be described below.

Next, the image signal output adjustment unit 83 calculates, on the basis of the sheet length L received from the processor 85 (the length calculator 851), the timing at which the color image signals for the second side generated by the image signal generator 82 are output to the exposure devices 13 of the image forming units 10 (positions of the photoconductor drums 11 at which the exposure devices 13 write the images) and the magnifications (or reductions), in the sub-scanning direction, of the color image signals for the second side generated by the image signal generator 82 (step S107).

The operation controller 84 causes the switching device 71 to switch the path of the one-side recorded sheet S to a reverse-transport path before the leading end of the sheet S reaches the switching device 71, and causes the reversing device 72 to reverse the transport direction of the sheet S and to flip the sheet S over. As a result, the reverse-transport mechanism 70 reversely transports the one-side recorded sheet S to a transport path that is upstream of the second-transfer device 30 in the transport direction (step S108).

Next, the image signal generator 82 generates color image signals for forming color images on the second side of the sheet S on the basis of input image data. The operation controller 84 causes the one-side recorded sheet S to be reversely transported further. The image signal output adjustment unit 83 adjusts the color image signals for the second side, which have been generated by the image signal generator 82, in accordance with the writing positions and the magnifications calculated in step S107. Then, the image signal output adjustment unit 83 outputs the color image signals to the image forming units 10 (to be specific, the exposure devices 13 of the image forming units 10) in sync with feeding of the one-side recorded sheet S (step S109), which is reversely transported.

Thus, the image forming units 10 form color images in accordance with the color images signals. To be specific, the operation controller 84 causes the photoconductor drums 11 of the image forming units 10 to rotate, causes the charging devices 12 to charge the rotating photoconductor drums 11, causes the exposure devices 13 to expose the photoconductor drums 11 with light beams in accordance with the color image signals for the second side, thereby forming electrostatic latent images on the surfaces of the photoconductor drums 11. Next, the operation controller 84 causes the developing devices 14 for the corresponding colors to develop the electrostatic latent images formed on the photoconductor drums 11, thereby forming color images for the second side. The operation controller 84 causes the first-transfer devices 15 to successively first-transfer the color images for the second side from the photoconductor drums 11 to the intermediate transfer belt 20, which rotates together with the photoconductor drums 11 (step S110). The images for the second side, which have been first-transferred to the intermediate transfer belt 20 in an overlapping manner, are moved toward the second-transfer position as the intermediate transfer belt 20 rotates.

The one-side recorded sheet S is reversely transported by the transport rollers 43 and reaches the second-transfer position again. The operation controller 84 causes the second-transfer device 30 to second-transfer the images for the second side from the intermediate transfer belt 20 to the second side of the sheet S (step S111).

Next, the operation controller 84 causes the fixing device 50 to fix the images onto the sheet S, by, for example, heating and pressing the sheet S, and causes the cooling device 55 to cool the sheet S, which has been heated by the fixing device 50 (step S112). The sheet S passes through the cooling device 55, is decurled by the decurler 60, and is transported further.

The operation controller 84 causes the switching device 71 to switch the path of the double-side printed sheet S, on both sides of which images have been fixed, to the transport path for outputting the sheet S to the outside of the image forming apparatus before the leading end of the sheet reaches the switching device 71. Therefore, the double-side recorded sheet S is transported and output to the outside of the image forming apparatus (step S113), and the process is finished.

After the above-described double-side image formation process has been performed on each of plural sheets S, a booklet is made by binding the double-side recorded sheets S. At this time, even if the sheet length L differs among the sheets S, image forming conditions such as the writing positions and the magnifications in the sub-scanning direction are adjusted on the basis of the sheet length L measured by the length measuring device 100. Therefore, displacement amounts among the recorded positions of the sheets S when forming a horizontally double-spread or a vertically double-spread booklet are reduced, whereby a high-quality booklet is bound as compared with the case where the adjustment based on the sheet length L is not performed.

In this example, displacement of images formed on the first and second sides of the sheet S is reduced by adjusting the image signals for the second side, which are output to the exposure devices 13, by using the image signal output adjustment unit 83. However, a method for reducing displacement of images is not limited thereto. For example, magnifications in the sub-scanning direction may be adjusted by adjusting the ratios of the rotation speeds of the photoconductor drums 11 to the movement speed of the intermediate transfer belt 20.

Figures 6A, 6B, 6C:
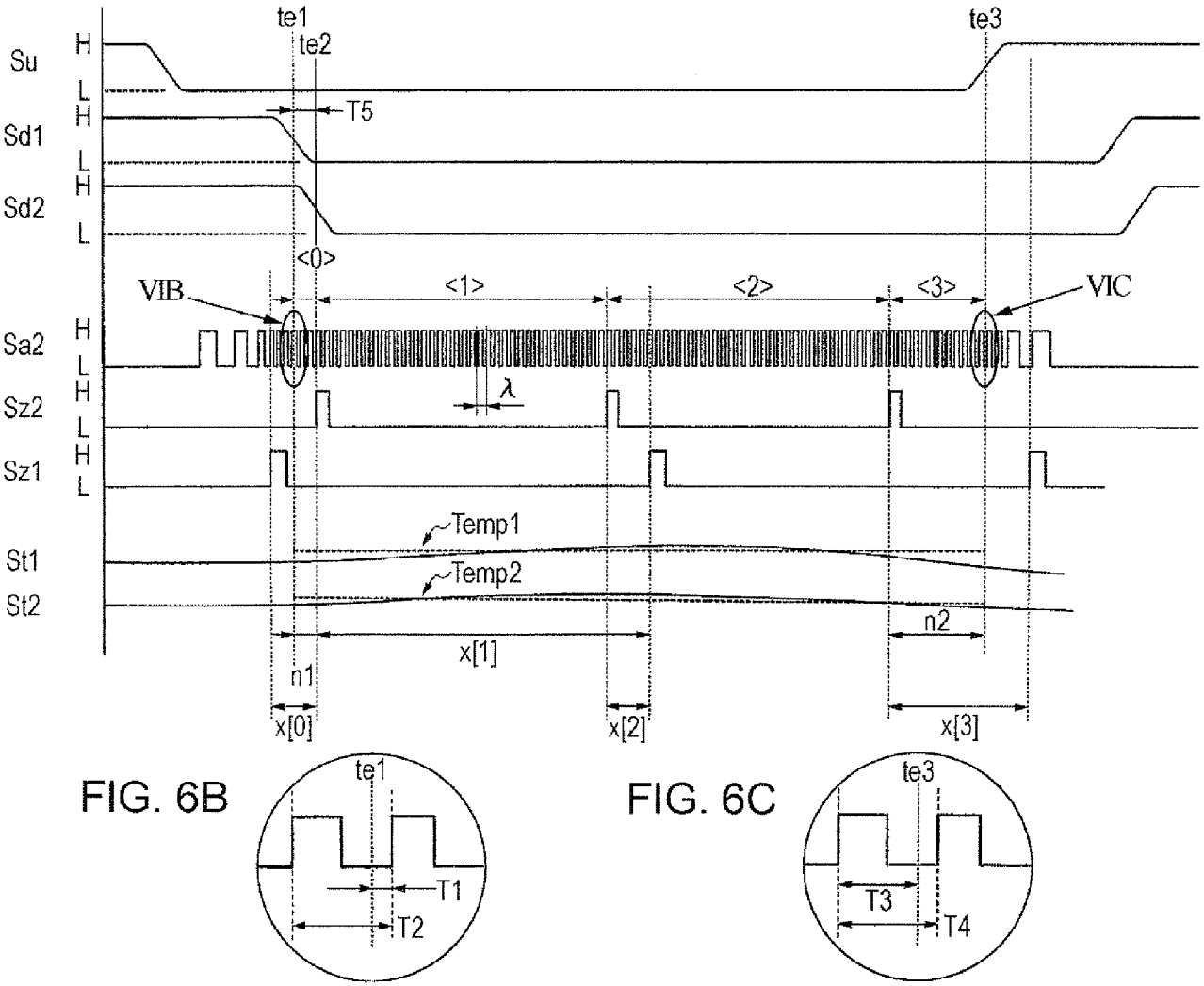
FIG. 6A is a timing chart illustrating the relationship among an upstream edge signal, a first downstream edge signal, a second downstream edge signal, a second A-phase signal, a second Z-phase signal, a first Z-phase signal, a first temperature signal, and a second temperature signal, which are output before and after a sheet passes through the length measuring device.
FIG. 6B is an enlarged view of a region VIB of FIG. 6A.
FIG. 6C is an enlarged view of a region VIC of FIG. 6A.

FIG. 6A is a timing chart illustrating the relationship among the upstream edge signal Su, the first downstream edge signal Sd1, the second downstream edge signal Sd2, the second A-phase signal Sa2, the second Z-phase signal Sz2, the first Z-phase signal Sz1, the first temperature signal St1, and the second temperature signal St2, which are output before and after the sheet S passes through the length measuring device 100. FIG. 6B is an enlarged view of a region VIB of FIG. 6A, and FIG. 6C is an enlarged view of a region VIC of FIG. 6A. In FIG. 6A, the first A-phase signal Sa1 is not illustrated.

In the initial state before the sheet S enters the length measuring device 100, the upstream edge signal Su, the first downstream edge signal Sd1, and the second downstream edge signal Sd2 are each at a high level (H), because the sheet S is not present. In the initial state, the second A-phase signal Sa2, the second Z-phase signal Sz2, and the first Z-phase signal Sz1 are each at a certain level (in this example, a low level (L)), because the first roller 110 and the second roller 120 are not rotating.

When the leading end of the sheet S in the transport direction (hereinafter, simply referred to as "the leading end") reaches the detection position of the upstream sensor 150 as the sheet S is transported, the upstream edge signal Su changes from the high level to the low level.

Next, when the leading end of the transported sheet S reaches a position at which the sheet S contacts the first roller 110, the first roller 110 starts rotating due to a force applied by the sheet S. Then, the second roller 120, which is in contact with the first roller 110, and the third roller 140, which faces the first roller 110 with the sheet S therebetween, start rotating. Thus, the first encoder wheel 171 starts rotating together with the first roller 110, and the second encoder wheel 181 starts rotating together with the second roller 120. As a result, the second A-phase signal Sa2 (and the first A-phase signal Sa1 (not shown)) alternates between the high level and the low level. The first roller 110 does not instantly follow the speed of the sheet S after the first roller 110 starts rotating, but the speed of the first roller 110 gradually increases. Therefore, the speed of the second roller 120, which is rotated by the first roller 110, gradually increases. As a result, the intervals between the high level and the low level of the second A-phase signal Sa2 (and the first A-phase signal Sa1 (not shown)) gradually decrease. In the following description, a period from the time at which the second A-phase signal Sa2 changes (hereinafter referred to as "rises") from the low level to the high level to the next time at which the second A-phase signal Sa2 rises will be referred to as "one pulse".

Subsequently, at a first time te1 at which the leading end of the transported sheet S reaches the detection position of the first downstream sensor 151, the first downstream edge signal Sd1 changes from the high level to the low level. In this example, at a second time te2 at which the leading end of the transported sheet S reaches the detection position of the second downstream sensor 152, the second downstream edge signal Sd2 changes from the high level to the low level.

Which of the first downstream sensor 151 and the second downstream sensor 152 first detects the leading end of the sheet S depends on the orientation (inclination) of the transported sheet S. FIG. 6A illustrates an example in which the first downstream sensor 151 detects the leading end of the sheet S before the second downstream sensor 152 does. However, this temporal relationship may be the opposite. In the present exemplary embodiment, irrespective of the temporal relationship, the first time te1 refers to the time at which the first downstream sensor 151, which is disposed downstream of the upstream sensor 150, detects the leading end of the sheet S, and the second time te2 refers to the time at which the second downstream sensor 152 detects the leading end of the sheet S. The first downstream sensor 151 outputs an analog signal as the first downstream edge signal Sd1, and the second downstream sensor 152 outputs an analog signal as the second downstream edge signal Sd2. In the present exemplary embodiment, the first time te1 and the second time te2 are each determined on the basis of a threshold that is the mean value of the high level and the low level.

At the first time te1 and at the second time te2, the upstream edge signal Su maintains the low level. By the second time te2, the first roller 110 rotates at a speed corresponding to that of the sheet S, and the second roller 120, which is rotated by the first roller 110, rotates at a speed corresponding to that of the sheet S.

After the second time te2, at a third time te3 at which the trailing end of the sheet S in the transport direction (hereinafter, simply referred to as "the trailing end") reaches the detection position of the upstream sensor 150, the upstream edge signal Su changes from the low level to the high level. In the present exemplary embodiment, for the above-described reason, the third time te3 is determined by using a threshold that is the mean value of the low level and the high level.

At the third time te3, the sheet S is passing a position at which the first roller 110 and the third roller 140 are disposed opposite each other, whereby the first roller 110 and the second roller 120 continue rotating. At the third time te3, the first downstream edge signal Sd1 and the second downstream edge signal Sd2 each maintain the low level.

After the third time te3, when the trailing end of the transported sheet S has passed the position at which the sheet faces the first roller 110, the first roller 110 does not receive a force from the sheet S and the second roller 120 does not receive a force from the first roller 110. However, the first roller 110 does not immediately stop rotating, but gradually decelerates and then stops rotating. As a result, the intervals between the high level and the low level of the second A-phase signal Sa2 (and the first A-phase signal Sa1) gradually increase, and finally the level becomes constant (in this example, at the low level).

When the trailing end of the transported sheet S passes the detection position of the first downstream sensor 151, the first downstream edge signal Sd1 changes from the low level to the high level. When the trailing end of the transported sheet S passes the detection position of the second downstream sensor 152, the second downstream edge signal Sd2 changes from the low level to the high level. Thus, when one sheet S has passed through the length measuring device 100, the signals (excluding the first temperature signal St1 and the second temperature signal St2) that are output from the length measuring device 100 return to the initial state, and stand by until transportation of the next sheet S starts.

The first time te1, at which the first downstream sensor 151 detects the leading end of the sheet S, is not necessarily the same as the timing at which the second A-phase signal Sa2 rises (see FIG. 6B). In the following description, the period between the first time te1 and the timing at which the second A-phase signal Sa2 rises right after the first time te1 will be referred to as a leading-end fractional pulse period T1, and one pulse period of the second A-phase signal Sa2 that includes the leading-end fractional pulse period T1 will be referred to as a leading-end one pulse period T2.

The third time te3, at which the upstream sensor 150 detects the trailing end of the sheet S, is not necessarily the same as the timing at which the second A-phase signal Sa2 rises (see FIG. 6C). In the following description, the period between the third time te3 and the timing at which the second A-phase signal Sa2 has risen right before the third time te3 will be referred to as a trailing-end fractional pulse period T3, and one pulse period of the second A-phase signal Sa2 that includes the trailing-end fractional pulse period T3 will be referred to as a trailing-end one pulse period T4.

In the following description, a period between the first time te1 and the second time te2 will be referred to as an inclination detection period T5. The inclination detection period T5 is calculated with respect to the first time te1. Therefore, the inclination detection period T5 may have a positive value (when the second time te2 is after the first time te1) and may have a negative value (when the second time te2 is before the first time te1).

Although not described above, every time the first encoder wheel 171 rotates once together with the first roller 110, the first Z-phase signal Sz1 changes between the low level and the high level. Every time the second encoder wheel 181 rotates once together with the second roller 120, the second Z-phase signal Sz2 changes between the low level and the high level. In this example, as is clear from FIG. 2 and other figures, the diameter of the second roller 120 is smaller than that of the first roller 110, so that one period of the second Z-phase signal Sz2 is shorter than one period of the first Z-phase signal Sz1.

Figure 7:
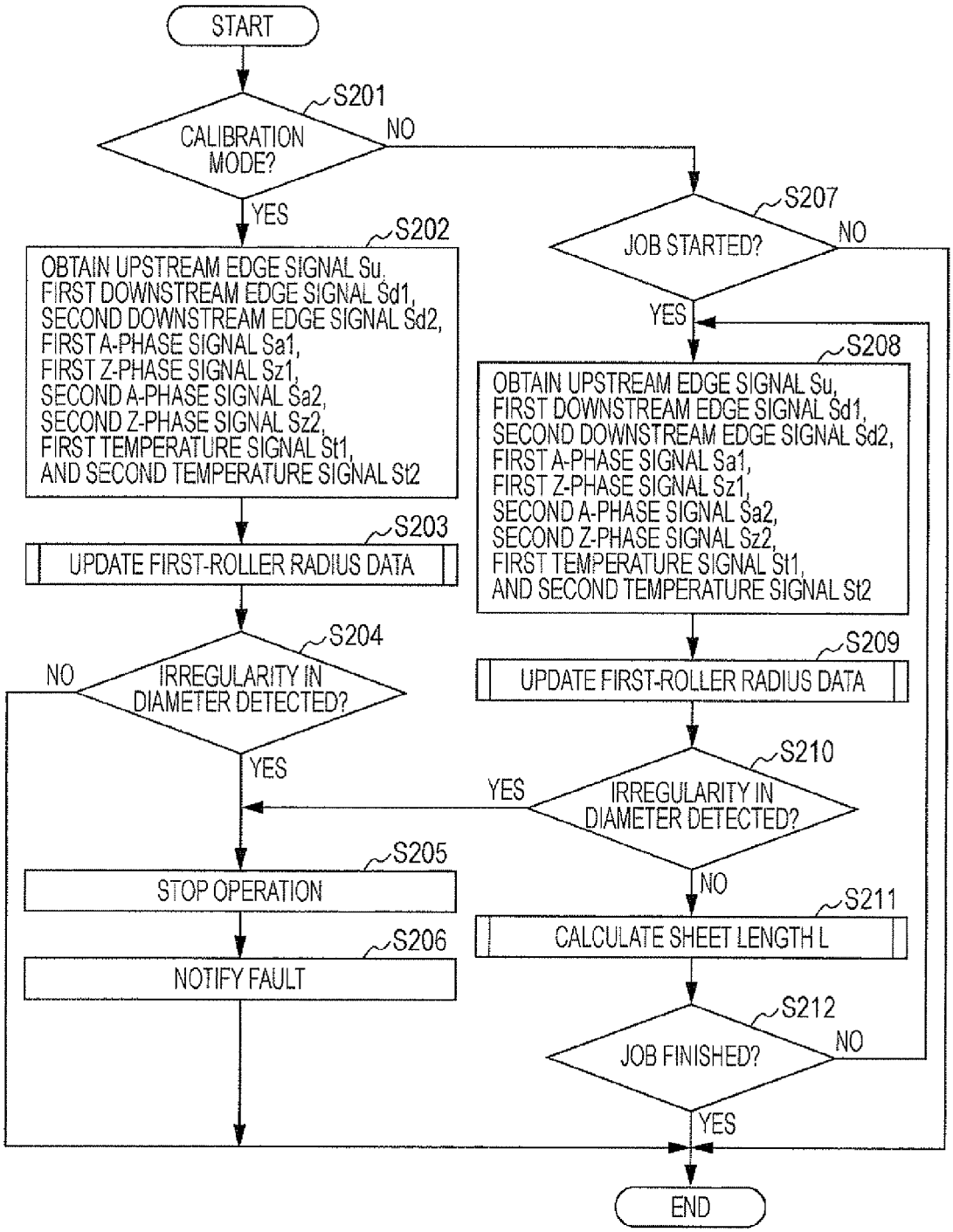
FIG. 7 is a flowchart illustrating a process performed by a processor.

FIG. 7 is a flowchart illustrating a process performed by the processor 85.

The processor 85 determines whether or not a calibration mode has been set through the UI 90 (step S201). If the calibration mode has been set, the image forming apparatus according to the present exemplary embodiment transports the sheet S through the length measuring device 100. An image need not be formed on the transported sheet S.

If the determination in step S201 is "yes", as the sheet S passes through the length measuring device 100, the upstream edge signal Su, the first downstream edge signal Sd1, the second downstream edge signal Sd2, the first A-phase signal Sa1, the first Z-phase signal Sz1, the second A-phase signal Sa2, the second Z-phase signal Sz2, the first temperature signal St1, and the second temperature signal St2, which are illustrated in FIG. 6A, are input to the processor 85 (step S202).

The first-roller radius calculator 853 of the processor 85 calculates a first-roller radius data r1_new on the basis of these signals and various data read from the storage unit 854. Then, the updating unit 856 stores the calculated first-roller radius data r1_new in the storage unit 854, thereby updating the first-roller radius data r1_new (step S203). The details of the first-roller radius data r1_new and step S203 will be described below.

Next, the determination unit 855 of the processor 85 detects whether or not an irregularity in the diameter of the first roller 110 exists on the basis of the first-roller radius data r1_new, which has been calculated by the first-roller radius calculator 853 (step S204).

If the determination in step S204 is "no", i.e., if an irregularity in the diameter is not detected, the processor 85 finishes the process in the calibration mode.

If the determination in step S204 is "yes", i.e., if an irregularity in the diameter is detected, the determination unit 855 outputs a control signal to the operation controller 84 to stop the operation of the image forming apparatus (step S205), outputs a control signal to the UI 90 to cause the UI 90 to perform fault notification (step S206), and subsequently finishes the process.

If the determination in step S201 is "no", the processor 85 determines whether or not a command for starting an image forming operation (job) has been received through the UI 90 or the like (step S207).

If the determination in step S207 is "yes", as the sheet S passes through the length measuring device 100 during the image forming operation, the upstream edge signal Su, the first downstream edge signal Sd1, the second downstream edge signal Sd2, the first A-phase signal Sa1, the first Z-phase signal Sz1, the second A-phase signal Sa2, the second Z-phase signal Sz2, the first temperature signal St1, and the second temperature signal St2, which are illustrated in FIG. 6A, are input to the processor 85 (step S208).

The first-roller radius calculator 853 of the processor 85 calculates the first-roller radius data r1_new on the basis of these signals and various data read from the storage unit 854. Then, the updating unit 856 stores the calculated first-roller radius data r1_new in the storage unit 854, thereby updating the first-roller radius data r1_new (step S209).

Next, the determination unit 855 of the processor 85 detects whether or not an irregularity in the diameter of the first roller 110 exists on the basis of the first-roller radius data r1_new, which has been calculated by the first-roller radius calculator 853 (step S210). The operations performed in step S209 and step S210 are the same as those performed in step S203 and step S204, respectively.

If the determination in step S210 is "no", i.e., if an irregularity in the diameter is not detected, the length calculator 851 of the processor 85 calculates the sheet length L, which is the length of the sheet S in the transport direction, on the basis of various signals input from the outside and various data read from the storage unit 854 (including the first-roller radius data r1_new, which has been updated in step S209) (step S211).

Then processor 85 determines whether or not the job has been finished (step S212). If the determination in step S212 is "no", the process returns to step S208, and the sheet length L of the next sheet S is calculated. If the determination in step S212 is "yes", the process of the job is finished. If the determination in step S207 is "no", the process is finished without calculating the sheet length L.

If the determination in step S210 is "yes", i.e., if an irregularity in the diameter is detected, the determination unit 855 outputs a control signal to the operation controller 84 to stop the operation of the image forming apparatus (step S205), outputs a control signal to the UI 90, causes the UI 90 to perform fault notification (step S206), and subsequently finishes the process.

Referring FIGS. 4, 6, and other figures, a process for calculating the sheet length L (step S211), which is performed by the length calculator 851, will be described in detail. In the present exemplary embodiment, when calculating the sheet length L by using the length measuring device 100, correction is performed to reduce an error due to an irregularity in the diameter of the first roller 110, an error due to an irregularity in the diameter of the second roller 120, and an error due to displacement of the positions of the second A-phase slits 181*a*, which are used for measuring the sheet length L.

As the sheet S passes through the length measuring device 100, the upstream edge signal Su, the first downstream edge signal Sd1, the second downstream edge signal Sd2, the second A-phase signal Sa2, the second Z-phase signal Sz2, the first Z-phase signal Sz1, the first temperature signal St1, and the second temperature signal St2, which are illustrated in FIG. 6A, are input to the length calculator 851.

The length calculator 851 obtains the first time te1 from the first downstream edge signal Sd1, the second time te2 from the second downstream edge signal Sd2, and the third time te3 from the upstream edge signal Su, respectively.

Next, the length calculator 851 calculates the inclination detection period T5 on the basis of the first time te1 and the second time te2; calculates a first temperature Temp1 on the basis of the first time te1, the third time te3, and the first temperature signal St1; and calculates the second temperature Temp2 on the basis of the first time te1, the third time te3, and the second temperature signal St2. The first temperature Temp1 is the average of the first temperature signal St1 during the period from the first time te1 to the third time te3. The second temperature Temp2 is the average of the second temperature signal St2 during the period from the first time te1 to the third time te3.

Next, the length calculator 851 counts a second-roller rotation count N of the second roller 120 on the basis of the first time te1, the third time te3, the second A-phase signal Sa2, and the second Z-phase signal Sz2. The second-roller rotation count N represents the rotation count of the second roller 120 during the period from the first time te1 to the third time te3. In this example, the first rotation is defined as the 0-th rotation. FIG. 6A illustrates the 0-th rotation (represented by <0> in FIG. 6A) to the 3rd rotation (represented by <3> in FIG. 6A) (N=3). Hereinafter, a rotation of the second roller 120 during the period from the first time te1 to the third time te3 will be referred to as a "j-th rotation". Therefore, j is in the range of $0 \leqq j \leqq N$ (where j and N are integers).

The length calculator 851 counts an initial pulse count n1 and a terminal pulse count n2 on the basis of the first time te1, the third time te3, the second A-phase signal Sa2, and the second Z-phase signal Sz2. The initial pulse count n1 is the number of pulses of the second A-phase signal Sa2 that is counted during the 0-th rotation (j=0) of the second roller 120. The initial pulse count n1 is represented by an integer by omitting a fractional pulse right after the first time te1. The terminal pulse count n2 is the number of pulses of the second A-phase signal Sa2 that is counted during the final rotation (in this example, j=N=3) of the second roller 120. The terminal pulse count n2 is represented by an integer by omitting a fractional pulse right before the third time te3.

The length calculator 851 obtains the leading-end fractional pulse period T1 and the leading-end one pulse period T2 on the basis of the first time te1 and the second A-phase signal Sa2, and obtains the trailing-end fractional pulse period T3 and the trailing-end one pulse period T4 on the basis of the third time te3 and the second A-phase signal Sa2.

The length calculator 851 generates a second-roller rotation correction factor table R[j, i] for correcting an error due to an irregularity in the diameter of the first roller 110, an error due to an irregularity in the diameter of the second roller 120, and an error due to displacement of the positions of the second A-phase slits 181*a*, which are used for measuring the length of the sheet S. The second-roller rotation correction factor table R[j, i] is made on the basis of the phase difference between the first roller 110 and the second roller 120 (see $\Delta\theta$=x[j] in FIG. 6A) during the period from the first time te1 to the third time te3. The process for generating the second-roller rotation correction factor table R[j, i] will be described below.

The length calculator 851 calculates the sheet length L by using various numerical values and various data obtained in the above-described process. The following equations are used to calculate the sheet length L.

$$L=f4\,(Lm\cdot T5) \tag{1}$$

$$Lm=Lg+Lr \tag{2}$$

$$Lg=Lg0*\alpha*\mathrm{Temp1} \tag{3}$$

$$Lr=(Y1+Y2+Y3)*\lambda*\beta*\mathrm{Temp2} \tag{4}$$

$$Y1=f1(N,n1,n2,\times[O]\sim\times[N]) \tag{5}$$

$$Y2=f2(T1/T2,n1,\times[O]) \tag{6}$$

$$Y3=f3(T3/T4,n2,\times[N]) \tag{7}$$

As shown in equation (1), the sheet length L is represented by a skew correction function f4 having a corrected measured length Lm and the inclination detection period T5 as variables. As shown in equation (2), the corrected measured length Lm is the sum of a corrected gap length Lg and a measured roller length Lr.

The corrected gap length Lg, which corresponds to the period during which the sheet S is detected by only one of the upstream sensor 150 and the first downstream sensor 151, is obtained on the basis of the reference gap length Lg0 (see FIG. 2B), which is the distance between the upstream sensor 150 and the first downstream sensor 151. The measured roller length Lr, which corresponds to the period during which the sheet S is detected by the upstream sensor 150 and the first downstream sensor 151, i.e., the period from the first time te1 to the third time te3, is obtained on the basis of the rotation amount of the second roller 120 due to the rotation of the first roller 110.

To be specific, as shown in equation (3), the corrected gap length Lg is the product of the reference gap length Lg0, the thermal expansion coefficient $\alpha$ of the attachment member 190, and the first temperature Temp1. The reference gap length Lg0 and the thermal expansion coefficient $\alpha$ are stored in the storage unit 854 beforehand.

As shown in equation (4), the measured roller length Lr is the product of the sum of a roller first pulse count Y1, a roller second pulse count Y2, and a roller third pulse count Y3; the resolution $\lambda$ (see FIG. 6A) of the second A-phase slits 181*a*; the thermal expansion coefficient $\beta$ of the second roller 120; and the second temperature Temp2. The resolution $\lambda$ and the thermal expansion coefficient $\beta$ are stored in the storage unit 854 beforehand.

The roller first pulse count Y1 corresponds to the pulse count of the second A-phase signal Sa2 during the period from the end of the leading-end fractional pulse period T1 to the start of the trailing-end fractional pulse period T3. The roller second pulse count Y2 corresponds to the pulse count of the second A-phase signal Sa2 during the leading-end fractional pulse period T1. The roller third pulse count Y3 corresponds to the pulse count of the second A-phase signal Sa2 during the trailing-end fractional pulse period T3.

As shown in equation (5), the roller first pulse count Y1 is represented by a roller-encoder correction function f1 having the second-roller rotation count N of the second roller 120, the initial pulse count n1, the terminal pulse count n2, and the phase difference between rollers x[j] ($0 \leqq j < N$) as variables.

As shown in equation (6), the roller second pulse count Y2 is represented by a leading-end pulse count function f2 having the ratio between the leading-end fractional pulse period T1 and the leading-end one pulse period T2, the initial pulse count n1, and the 0-th phase difference between rollers x[0] as variables.

As shown in equation (7), the roller third pulse count Y3 is represented by a trailing end pulse count function f3 having the ratio between the trailing-end fractional pulse period T3 and the trailing-end one pulse period T4, the terminal pulse count n2, and the N-th phase difference between rollers x[N] as variables.

In the present exemplary embodiment, the pulse count of the second A-phase signal Sa2, which is used to calculate the measured roller length Lr when calculating the sheet length L, is corrected by using the second-roller rotation correction factor table R[j, i], which is obtained on the basis of the phase difference between rollers x[j], and thereby the roller first pulse count Y1, the roller second pulse count Y2, and the roller third pulse count Y3 are obtained.

Figure 8:
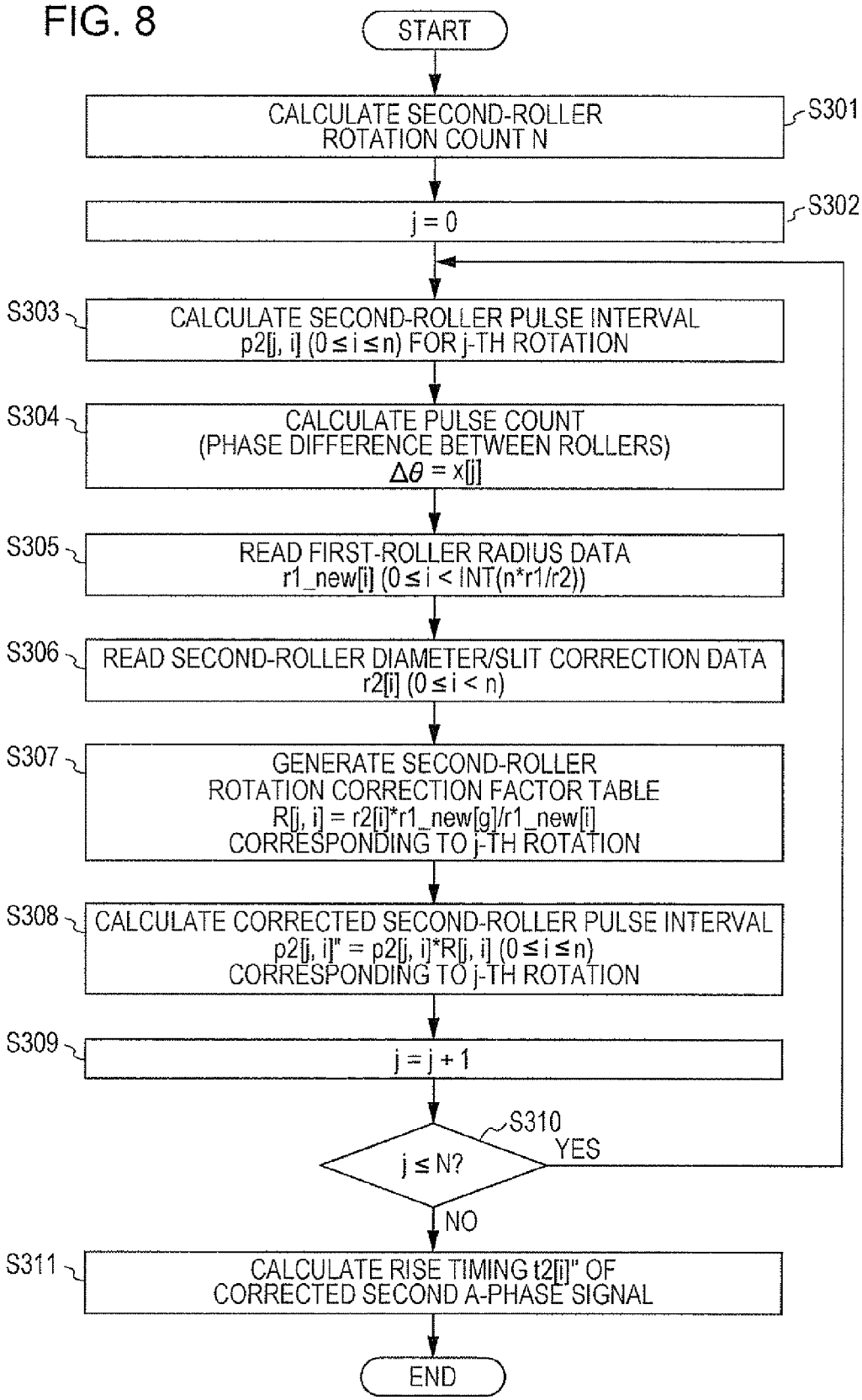
FIG. 8 is a flowchart illustrating a process for generating a second-roller rotation correction factor table.
Figure 9:
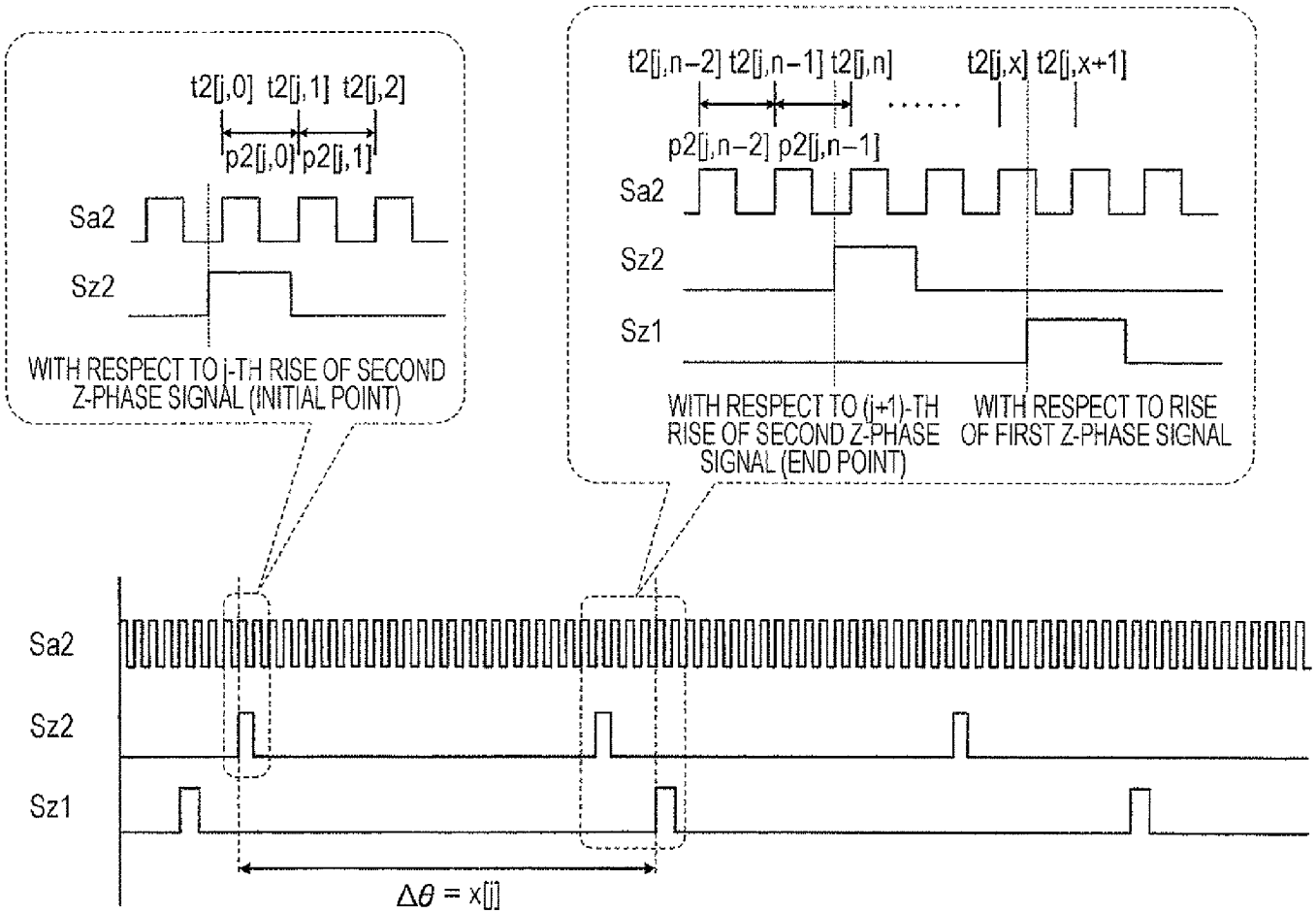
FIG. 9 illustrates an operation performed in step S303 of FIG. 8.
Figure 10:
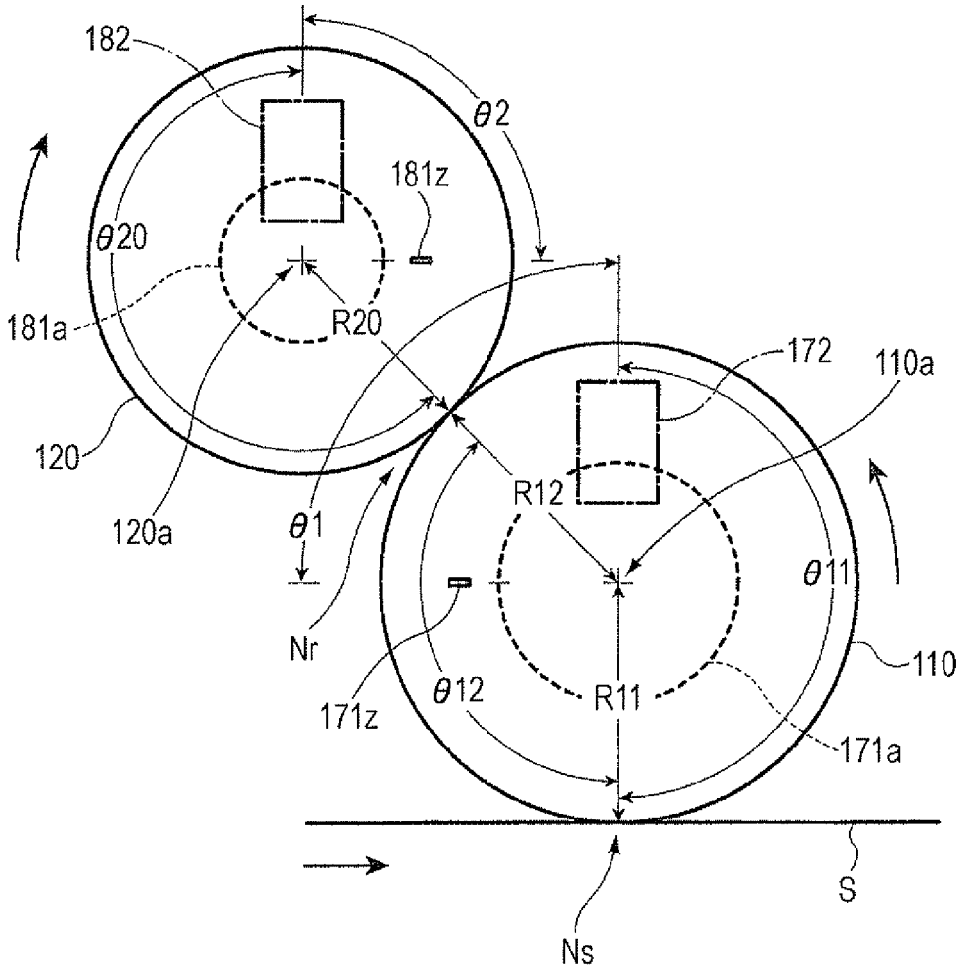
FIG. 10 illustrates why an error occurs when the length measuring device performs measurement.
Figure 11A:
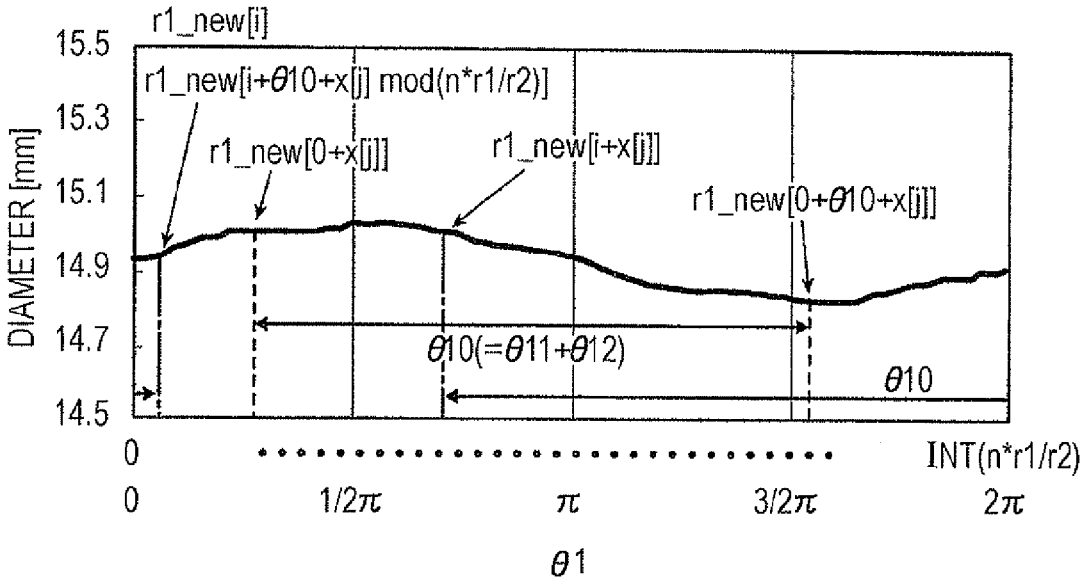
FIG. 11A illustrates an example of first-roller radius data.
Figure 11B:
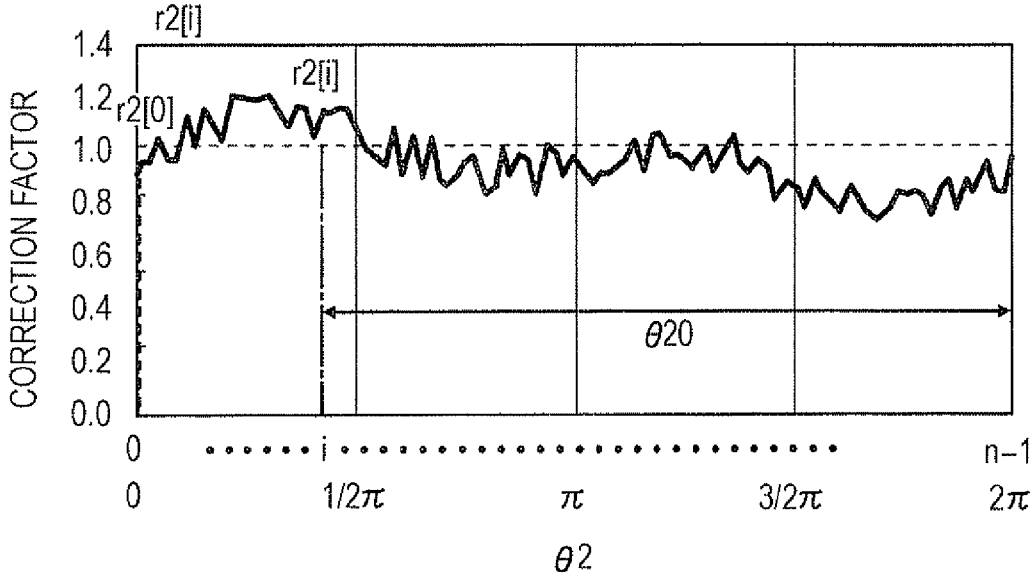
FIG. 11B illustrates an example of second-roller diameter/slit correction data.

FIG. 8 is a flowchart illustrating a process for generating the second-roller rotation correction factor table R[j, i]. FIG. 9 illustrates an operation performed in step S303 of FIG. 8. FIGS. 10, 11A, and 11B illustrate an operation performed in step S307 of FIG. 8.

First, the length calculator 851 calculates the second-roller rotation count N of the second roller 120 on the basis of the first time te1, the third time te3, and the second Z-phase signal Sz2 (step S301). Next, the length calculator 851 sets j=0 (step S302), and calculates a second-roller pulse interval p2[j, i] ($0 \leqq i \leqq n$) of the second A-phase signal Sa2 for the j-th rotation with respect to the j-th rise of the second Z-phase signal Sz2 (step S303, see also FIG. 9). Next, the length calculator 851 calculates the pulse count of the second A-phase signal Sa2 during the period from the j-th rise of the second Z-phase signal Sz2 to the j-th rise of the first Z-phase signal Sz1 as $\Delta\theta = x[j]$ (step S304, see FIG. 9).

Next, the length calculator 851 reads the first-roller radius data r1_new[i] ($0 \leqq i < INT(n*r1/r2)$) from the storage unit 854 (step S305, see FIG. 11A). The length calculator 851 reads a second-roller diameter/slit correction data r2[i] ($0 \leqq i \leqq n$) from the storage unit 854 (step S306, see FIG. 11B).

Subsequently, the length calculator 851 generates the second-roller rotation correction factor table R[j, i]=r2[i] *r1_new[g]/r1_new[i] on the basis of two sets of data (r1_new[i] ($x[j] \leqq i \leqq x[j]+n-1$ (mod INT(n*r1/r2))) and r1_new[g] ($x[j]+\theta 10 \leqq g \leqq x[j]+\theta 10+n-1$ (mod INT(n*r1/r2))) (see FIG. 11A), which have been obtained from the first-roller radius data r1_new[i] in step S305, and the second-roller diameter/slit correction data r2[i] ($0 \leqq i < n$), which has been read in step S306 (see FIG. 11B) (step S307).

Next, the length calculator 851 corrects the pulse intervals by using the second-roller pulse interval p2[j, i] obtained in step S303 and the second-roller rotation correction factor table R[j, i] obtained in step S307, and thereby calculates a corrected second-roller pulse interval p2[j, i]"=p2[j, i]*R[j, i] ($0 \leqq i \leqq n$) that corresponds to the j-th rotation (step S308). The length calculator 851 updates j to j+1 (step S309), and determines whether or not the updated value of j is equal to or smaller than the second-roller rotation count N (step S310). If the determination in step S310 is "yes", the process returns to step S303 and the process continues.

If the determination in step S310 is "no", the length calculator 851 calculates a rise timing t2[i]" of the corrected second A-phase signal Sa2 during the period from the first time te1 to the third time te3 on the basis of the corrected second-roller pulse interval p2[j, i]" ($0 \leqq j \leqq N$, $0 \leqq i < n$) (step S311), which has been obtained in step S308 for each second-roller rotation count N, and finishes the process.

FIGS. 10 to 11B will be described. FIG. 10 illustrates why an error occurs when the length measuring device 100 performs measurement. FIG. 11A illustrates an example of the first-roller radius data r1_new[i], and FIG. 11B illustrates an example of the second-roller diameter/slit correction data r2[i]. FIG. 10 does not illustrate the first encoder wheel 171 and the second encoder wheel 181, and schematically illustrates the first A-phase slits 171*a*, the first Z-phase slit 171*z*, the second A-phase slits 181*a*, and the second Z-phase slit 181*z*.

In the following description, the position at which the sheet S contacts the first roller 110 will be referred to as a sheet nip Ns, and the position at which the first roller 110 contacts the second roller 120 will be referred to as a roller nip Nr. A radius of the first roller 110 extending from the first rotation shaft 110*a* to the sheet nip Ns will be referred to as a first sheet nip radius R11, and the radius of the first roller 110 extending from the first rotation shaft 110*a* to the roller nip Nr will be referred to as a first-roller nip radius R12. A radius of the second roller 120 extending from the second rotation shaft 120*a* to the roller nip Nr will be referred to as a second-roller nip radius R20.

Regarding the first roller 110, the angle between the position of the first Z-phase slit 171*z* and the detection position of the first optical detector 172 for detecting the first Z-phase slit 171*z* around the first rotation shaft 110*a* will be referred to as a first-roller rotation angle θ1. Regarding the first roller 110, the angle between the detection position of the first optical detector 172 for detecting the first Z-phase slit 171*z* and the sheet nip Ns around the first rotation shaft 110*a* will be referred to as a first-roller first set angle θ11. Regarding the first roller 110, the angle between the sheet nip Ns and the roller nip Nr around the first rotation shaft 110*a* will be referred to as a first-roller second set angle θ12. The sum of the first-roller first set angle θ11 and the first-roller second set angle θ12, i.e., the angle between the detection position of the first optical detector 172 for detecting the first Z-phase slit 171*z* and the roller nip Nr around the first rotation shaft 110*a* will be referred to as a first-roller set angle θ10. The first-roller rotation angle θ1, the first-roller first set angle θ11, and the first-roller second set angle θ12 are defined so that the positive directions thereof are clockwise in FIG. 10, which is opposite to the rotation direction of the first roller 110 (counterclockwise in FIG. 10). The magnitude of the first-roller rotation angle θ1 changes in accordance with the rotation of the first roller 110. The magnitudes of the first-roller first set angle θ11 and the first-roller second set angle θ12 are fixed.

Regarding the second roller 120, the angle between the position of the second Z-phase slit 181*z* and the detection position of the second optical detector 182 for detecting the second Z-phase slit 181*z* around the second rotation shaft 120*a* will be referred to as a second-roller rotation angle θ2. Regarding the second roller 120, the angle between the detection position of the second optical detector 182 for detecting the second Z-phase slit 181*z* and the roller nip Nr around the second rotation shaft 120*a* will be referred to as a second-roller set angle θ20. The second-roller rotation angle θ2 and the second-roller set angle θ20 are defined so that the positive directions thereof are clockwise in FIG. 10, which is opposite to the rotation direction of the second roller 120 (counter-clockwise in FIG. 10). The magnitude of the second-roller rotation angle θ2 changes in accordance with the rotation of the second roller 120. The magnitude of the second-roller set angle θ20 is fixed.

The first roller 110 and the second roller 120 used in the present exemplary embodiment are made beforehand with an accuracy within a predetermined tolerance. Therefore, the first sheet nip radius R11 and the first-roller nip radius R12 of the first roller 110 may differ from each other. Because the first roller 110 rotates when a measuring operation is performed, the relationship between the first sheet nip radius R11 and the first-roller nip radius R12 may change from moment to moment in accordance with the rotation of the first roller 110. Because the second roller 120 rotates when a measuring operation is performed, the second-roller nip radius R20 may change from moment to moment in accordance with the rotation of the second roller 120. If the radii of the first roller 110 and the second roller 120 are designed to be different from each other (in this example, the radius of the first roller 110 is larger than that of the second roller 120), depending on the states (phases) of the first roller 110 and the second roller 120, the relationship between the first-roller nip radius R12 and the second-roller nip radius R20 may change from moment to moment in accordance with the rotations of the first roller 110 and the second roller 120.

The second encoder wheel 181 used in the present exemplary embodiment is also manufactured with an accuracy within a predetermined tolerance. Therefore, the intervals between the second A-phase slits 181*a*, which are supposed to be formed at regular intervals in the circumferential direction of the second encoder wheel 181, may be deviated from a design value.

If, for example, the first roller 110 has eccentricity, the surface velocity of the first peripheral surface portion 113 at the sheet nip Ns (referred to as a sheet nip velocity) may differ from the surface velocity of the first peripheral surface portion 113 at the roller nip Nr (referred to as a roller nip velocity). To be specific, the roller nip velocity is the product of the sheet nip velocity and (first-roller nip radius R12/first sheet nip radius R11).

If the second roller 120 has eccentricity, the rotation amount of the second encoder wheel 181 at the sheet nip Ns may differ from the rotation amount of the second encoder wheel 181 at a position corresponding to the second optical detector 182. Moreover, if the second A-phase slits 181*a* are not formed at regular intervals in the second encoder wheel 181, a difference arising therefrom is superposed on the difference due to the eccentricity.

Therefore, in the present exemplary embodiment, before shipping the image forming apparatus, measurement for determining the correspondence between the phase (rotation angle) of the first roller 110 and the radius distribution of the first roller 110 with respect to the position of the first Z-phase slit 171*z* is performed by using the length measuring device 100. The result of the measurement is stored in the storage unit 854 as initial first-roller radius data r1_init[i], which is an example of a reference radius distribution. The initial first-roller radius data r1_init[i], which is an example of a reference radius distribution, is used as the initial data for the first-roller radius data r1_new[i].

Moreover, in the present exemplary embodiment, before shipping the image forming apparatus, measurement for determining the correspondence among the phase (rotation angle) of the second roller 120, the radius distribution of the second roller 120, and the distribution of intervals between adjacent slits of the second A-phase slits 181*a* of the second encoder wheel 181 with respect to the position of the second Z-phase slit 181*z* is performed by using the length measuring device 100. The second-roller diameter/slit correction data r2[i], which is obtained by reversing the sign of the result of the measurement and then normalizing the result, is stored in the storage unit 854.

FIG. 11A illustrates an example of the first-roller radius data r1_new[i], and FIG. 11B illustrates an example of the second-roller diameter/slit correction data r2[i]. The first-roller radius data r1_new[i] and the second-roller correction data r2[i] are each stored in the storage unit 854 as numerical data representing the correspondence. For ease of understanding, FIGS. 11A and 11B illustrate the graphs of the data.

In FIG. 11A, the horizontal axis represents the first-roller rotation angle θ1 (rad), and the vertical axis represents the radius of the first roller 110 (mm). Referring to FIGS. 10 and 11A, when the first-roller rotation angle θ1 is, for example, π/2 (rad), the sheet nip Ns of the first roller 110 is at a position that is retarded from the first-roller rotation angle θ1 by the first-roller first set angle θ11 (π (rad) in the example of FIG. 11A), so that the first sheet nip radius R11 at this time has a value corresponding to θ1=3π/2 (rad). The roller nip Nr of the first roller 110 is at a position that is retarded from the first-roller rotation angle θ1 by the sum of the first-roller first set angle θ11 (π (rad) in the example of FIG. 11A) and the first-roller second set angle θ12 (3π/4 (rad) in the example of FIG. 11A), so that the first-roller nip radius R12 at this time has a value corresponding to θ1=9π/4 (rad), i.e., θ1=π/4 (rad). The first-roller rotation angle θ1 changes in accordance with the rotation of the first roller 110, while the first-roller first set angle θ11 and the first-roller second set angle θ12 (and the first-roller set angle θ10) do not change. Therefore, by obtaining the first-roller rotation angle θ1 of the first roller 110 by using the first Z-phase slit 171*z*, the first sheet nip radius R11 and the first-roller nip radius R12 at this time are obtained.

In FIG. 11B, the horizontal axis represents the second-roller rotation angle θ2 (rad), and the vertical axis represents the correction factor. Referring to FIGS. 10 and 11B, when the second-roller rotation angle θ2 is, for example, π/2 (rad), the roller nip Nr of the second roller 120 is at a position that is retarded from the second-roller rotation angle θ2 by the second-roller set angle θ20 (5π/4 (rad) in the example of FIG. 11B), so that the correction factor at this time has a value corresponding to θ2=7π/4 (rad).

In the present exemplary embodiment, when the length calculator 851 calculates the sheet length L, the second-roller rotation correction factor table R[j, i], which is generated on the basis of the phase difference between rollers x[j] by determining the correspondence between the first-roller radius data r1_new[i] and the second-roller diameter/slit correction data r2[i] read from the storage unit 854, is used to calculate the roller first pulse count Y1, the roller second pulse count Y2, and the roller third pulse count Y3. Thus, occurrence of error in the measured roller length Lr due to insufficient accuracy of the first roller 110, the second roller 120, or the second encoder wheel 181 is reduced, so that an error included in the sheet length L calculated by using the measured roller length Lr is reduced.

In the present exemplary embodiment, when the velocity calculator 852 calculates the sheet velocity V, the second-roller rotation correction factor table R[j, i], which is generated on the basis of the phase difference between rollers x[j] by determining the correspondence between the first-roller radius data r1_new[i] and the second-roller diameter/slit correction data r2[i] read from the storage unit 854, is used. Therefore, occurrence of an error in the sheet velocity V is reduced.

In the present exemplary embodiment, as described above, the surface layer 112 of the first roller 110 is made of an elastic material such as rubber, so that the first roller 110 may easily follow the transported sheet S. On the other hand, if the surface layer 112 of the first roller 110 is made of an elastic material, the surface layer 112 easily wears as compared with the case where the surface layer 112 is made of a metal or the like. In this case, wear that occurs on the surface layer 112 of the first roller 110 may be overall wear in which the entire periphery of the surface layer 112 is worn or may be local wear in which a part of the periphery of the surface layer 112 is worn. When the surface layer 112 of the first roller 110 is worn and the radius distribution of the first roller 110 changes, deviation of the actual radius distribution of the first roller 110 from the first-roller radius data r1_new[i] stored in the storage unit 854 increases, and thereby errors in the above-described calculations of the sheet length L and the sheet velocity V may increase. When local wear occurs on the first roller 110, the first roller 110 and the second roller 120 vibrate as the first roller 110 rotates, and thereby an error in the above-described calculations of the sheet length L and the sheet velocity V may increase.

Therefore, in the present exemplary embodiment, as described above with reference to FIG. 7, the first-roller radius data r1_new[i] is updated, and detection of an irregularity in the diameter of the first roller 110 is performed on the basis of the updated first-roller radius data r1_new[i].

Figure 12:
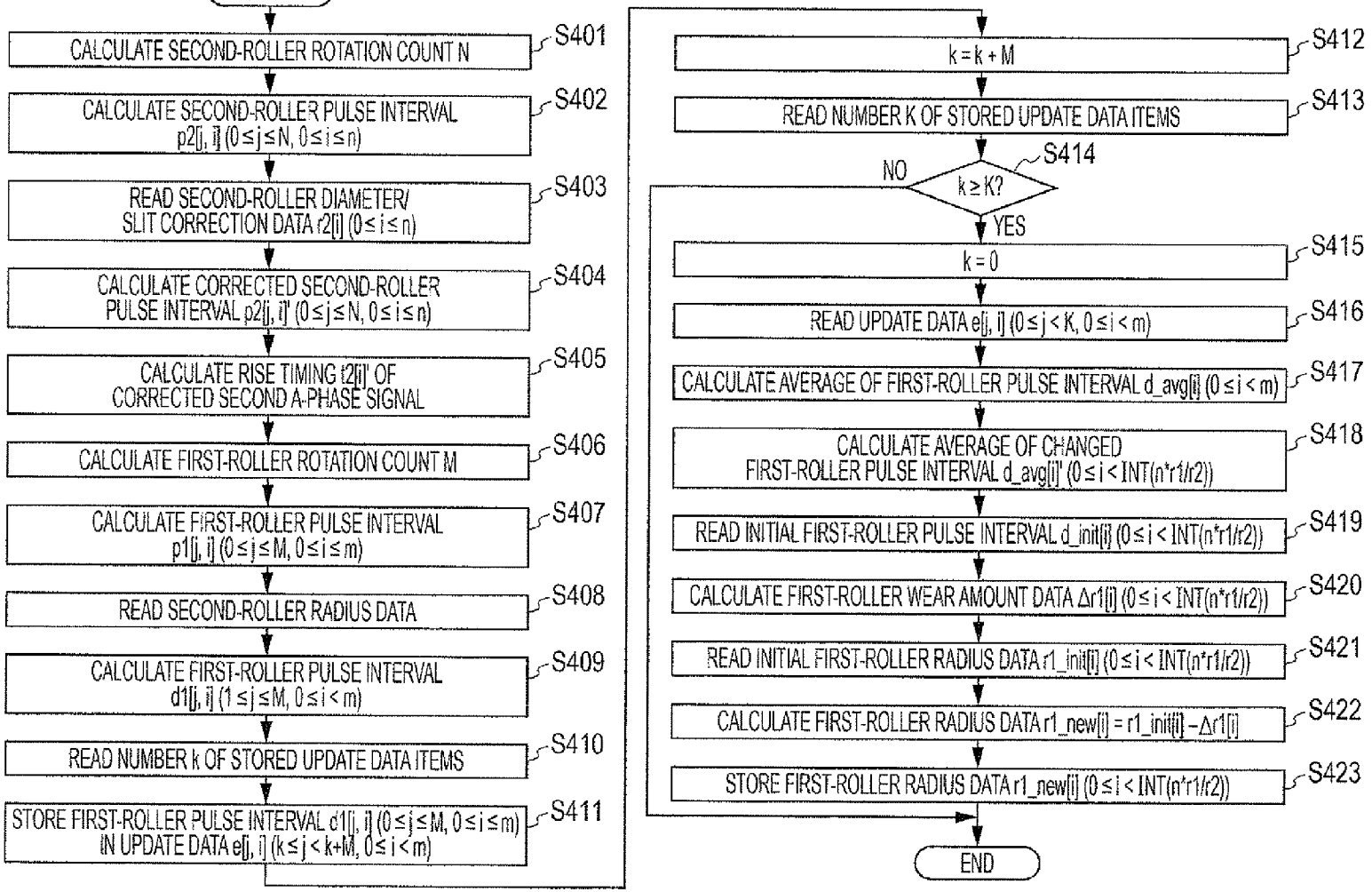
FIG. 12 is a flowchart illustrating a process for updating the first-roller radius data.
Figure 13:
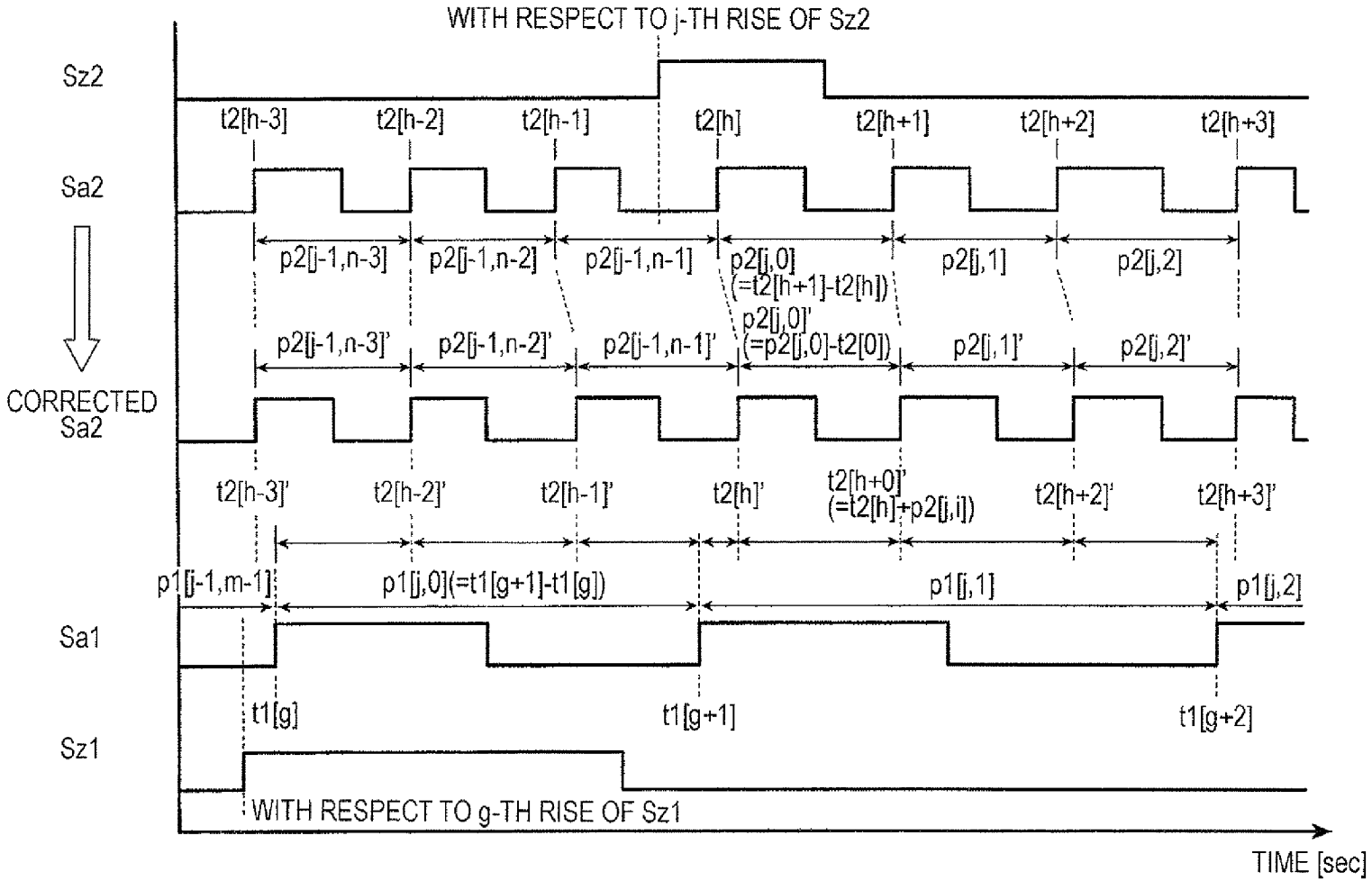
FIG. 13 illustrates an operation performed in steps S401 to S409 of FIG. 12.
Figure 14:
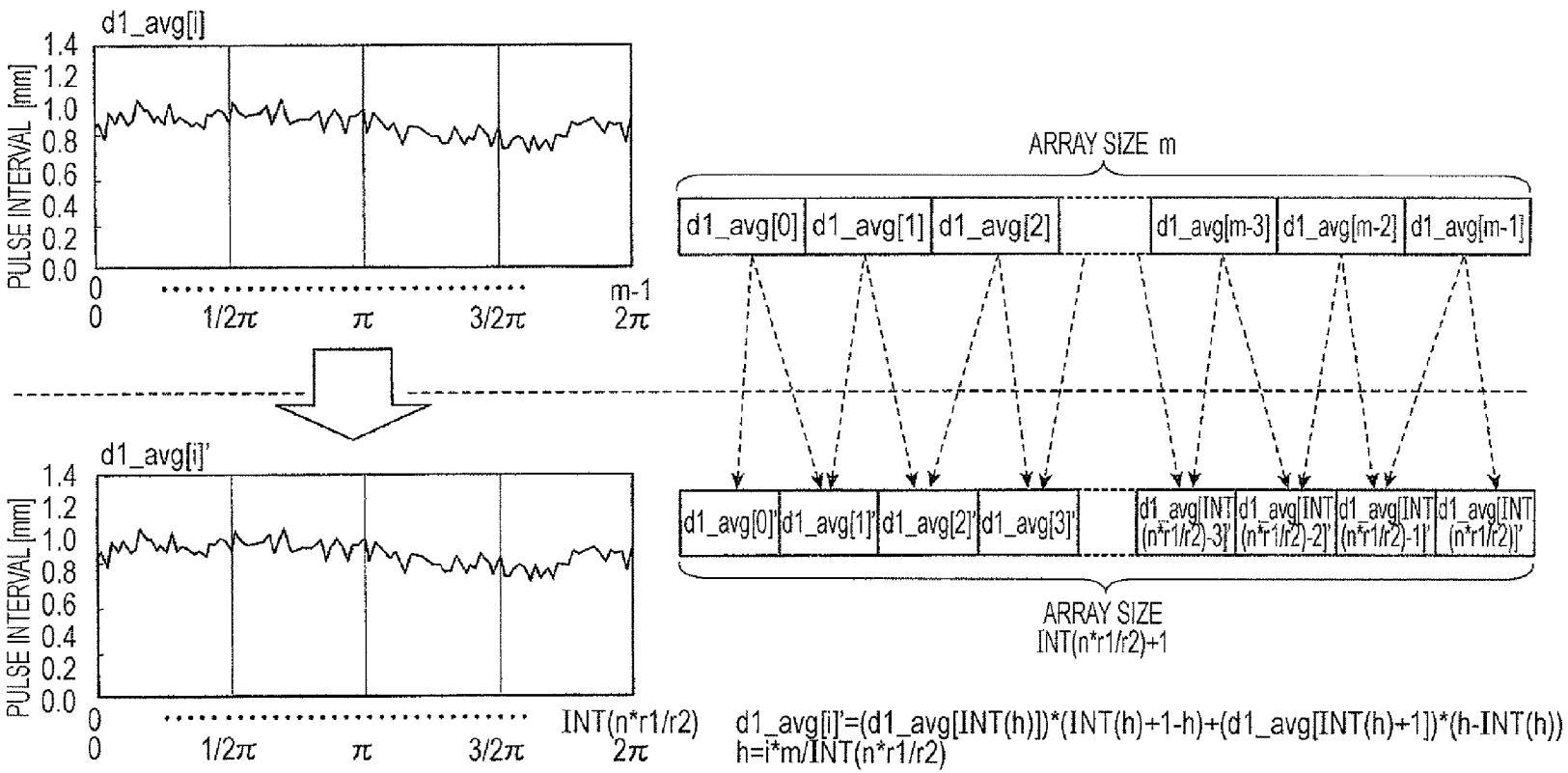
FIG. 14 illustrates an operation performed in step S418 of FIG. 12.
Figure 15:
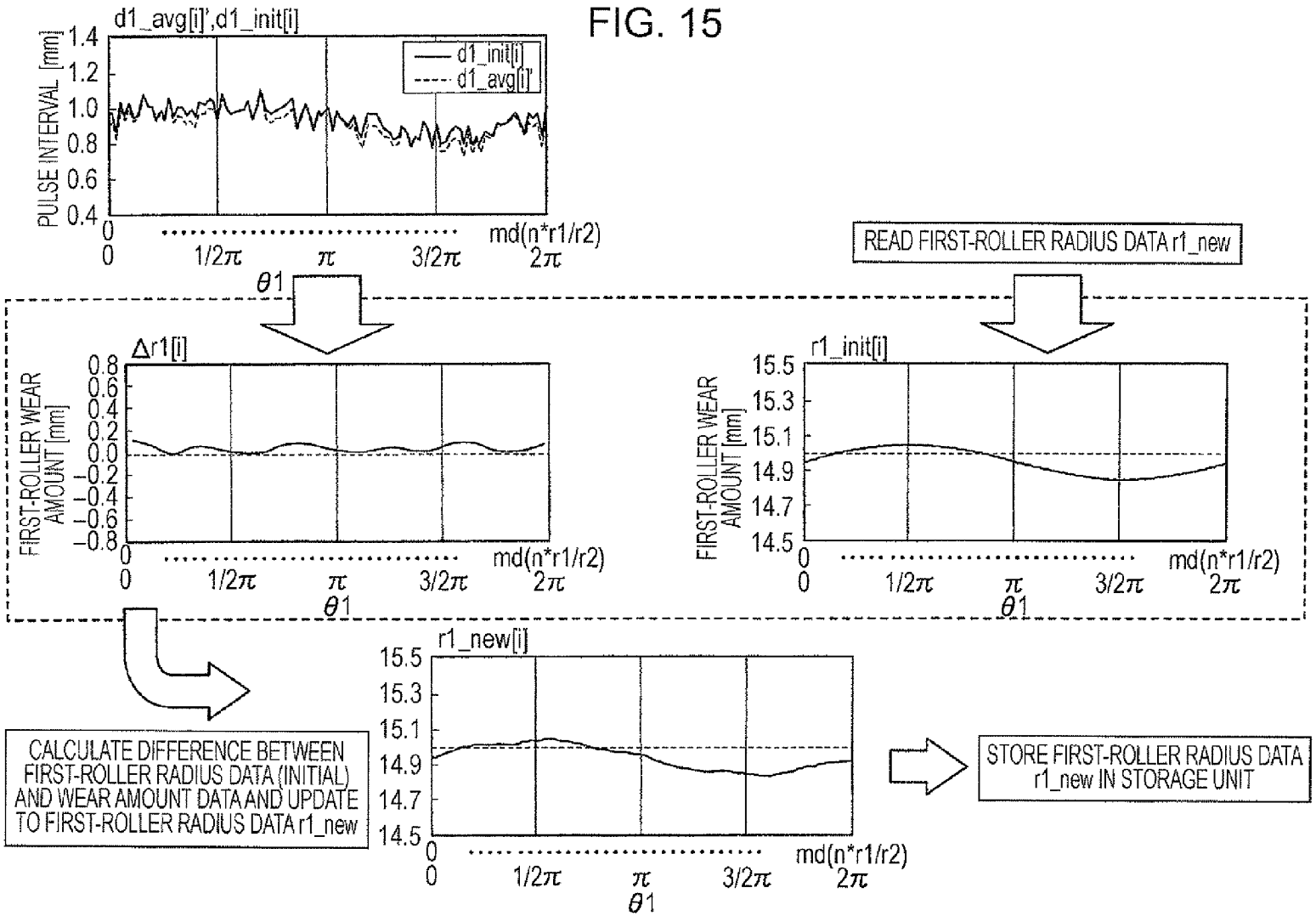
FIG. 15 illustrates an operation performed in steps S419 to S423 of FIG. 12.

FIG. 12 is a flowchart illustrating a process for updating the first-roller radius data r1_new[i] for the first roller 110, which is performed in steps S203 and S209 illustrated in FIG. 7. FIG. 13 illustrates an operation performed in steps S401 to S409 of FIG. 12. FIG. 14 illustrates an operation performed in step S418 of FIG. 12. FIG. 15 illustrates an operation performed in steps S419 to S423 of FIG. 12.

First, the first-roller radius calculator 853 calculates the second-roller rotation count N of the second roller 120 on the basis of the first time te1, the third time te3, the second A-phase signal Sa2, and the second Z-phase signal Sz2 (step S401). Next, the first-roller radius calculator 853 calculates the second-roller pulse interval p2[j, i] ($0 \leqq i \leqq N$, $0 \leqq i \leqq n$) of the second A-phase signal Sa2 with respect to the rise of the second Z-phase signal Sz2 (step S402).

Next, the first-roller radius calculator 853 reads the second-roller diameter/slit correction data r2[i] ($0 \leqq i \leqq n$) from the storage unit 854 (step S403, see FIG. 11B).

The first-roller radius calculator 853 corrects the pulse intervals by using the second-roller pulse interval p2[j, i] obtained in step S402 and the second-roller diameter/slit correction data r2[i] read in step S403, and thereby calculates the corrected second-roller pulse interval p2[j, i]'=p2[j, i]*r2[i] ($0 \leqq j \leqq N$, $0 \leqq i \leqq n$) (step S404, see FIG. 13). For this correction, the first-roller radius data r1_new[i] is not taken into account because the second-roller rotation correction factor table R[j, i] is not used.

Next, the first-roller radius calculator 853 calculates the rise timing t2[i]' of the corrected second A-phase signal Sa2 during the period from the first time te1 to the third time te3 on the basis of the corrected second-roller pulse interval p2[j, i]' ($0 \leqq j \leqq N$, $0 \leqq j < n$) obtained in step S404 (step S405, see FIG. 13).

The first-roller radius calculator 853 calculates a first-roller rotation count M of the first roller 110 on the basis of the first time te1, the third time te3, and the first Z-phase signal Sz1 (step S406). Next, the first-roller radius calculator 853 calculates the first-roller pulse interval p1[j, i] ($0 \leqq j \leqq M$, $0 \leqq i \leqq m$) of the first A-phase signal Sa1 with respect to the rise of the first Z-phase signal Sz1 (step S407, see FIG. 13).

Next, the first-roller radius calculator 853 reads the second-roller radius data from the storage unit 854 (step S408). The second-roller radius data represents the correspondence between the second-roller rotation angle θ2 of the second roller 120 and the radius of the second roller 120.

Then, the first-roller radius calculator 853 calculates the first-roller pulse interval d1[j, i] ($1 \leqq j \leqq M$, $0 \leqq i < m$) by using the first-roller pulse interval p1[j, i] obtained in step S407, the rise timing t2[i]' of the corrected second A-phase signal Sa2 obtained in step S405, and the average of the second-roller radius data read in step S408 (step S409). Subsequently, the first-roller radius calculator 853 reads the number k of stored update data items from the storage unit 854 (step S410).

Next, the first-roller radius calculator 853 substitutes the first-roller pulse interval d1[j, i] ($1 \leqq j \leqq M$, $0 \leqq i < m$) obtained in step S409 into the update data e[j, i] ($k \leqq j < k+M$, $0 \leqq i < m$), and stores the result in the storage unit 854 (step S411). Then, the first-roller radius calculator 853 updates the number k of stored update data items to k+M (step S412), and reads the number K of update data items from the storage unit 854 (step S413). The first-roller radius calculator 853 determines whether or not the number k of stored update data items updated in step S412 is equal to or larger than the number K of update data items read in step S413 (step S414).

If the determination in step S414 is "yes", the first-roller radius calculator 853 sets the number k of stored update data items at 0 (step S415), and reads update data e[j, i] ($0 \leqq j < K$, $0 \leqq i < m$) stored in the storage unit 854 in step S411 (step S416). Then, the first-roller radius calculator 853 performs averaging of K update data items e[j, i] ($0 \leqq j < K$, $0 \leqq i < m$) read in step S416, and calculates the average d_avg[i] ($0 \leqq i < m$) of the first-roller pulse interval (step S417, see the upper part of FIG. 14). Next, the first-roller radius calculator 853 changes the array number of the average value d_avg[i] ($0 \leqq i < m$) of the first-roller pulse interval calculated in step S417 from m to INT(n*r1/r2), and calculates the average d_avg[i]' ($0 \leqq i <$ INT(n*r1/r2)) of the changed first-roller pulse interval (step S418, see the lower part of FIG. 14). Next, the first-roller radius calculator 853 reads the initial first-roller pulse interval d_init[i] ($0 \leqq i <$ INT(n*r1/r2)) from the storage unit 854 (step S419, see the upper part of FIG. 15).

The first-roller radius calculator 853 calculates first-roller wear amount data Δr1[i] ($0 \leqq i <$ INT(n*r1/r2)) by calculating the difference between the average d_avg[i]' ($0 \leqq i <$ INT(n*r1/r2)) of the changed first-roller pulse interval, which has been obtained in step S418, and the initial first-roller pulse interval d_init[i] ($0 \leqq i <$ INT(n*r1/r2)) read in step S419 (step S420, see the left middle part of FIG. 15).

Next, the first-roller radius calculator 853 reads the initial first-roller radius data r1_init[i] ($0 \leqq i <$ INT(n*r1/r2)) from the storage unit 854 (step S421, see the right middle part of FIG. 15). The first-roller radius calculator 853 calculates new first-roller radius data r1_new[i] ($0 \leqq i <$ INT(n*r1/r2)) by calculating the difference between the initial first-roller radius data r1_init[i] ($0 \leqq i <$ INT(n*r1/r2)) read in step S421 and the first-roller wear amount data Δr1_init[i] ($0 \leqq i <$ INT(n*r1/r2)) obtained in step S420 (step S422, see the lower part of FIG. 15). Then, the first-roller radius calculator 853 stores the new first-roller radius data r1_new[i] ($0 \leqq i <$ INT(n*r1/r2)) in the storage unit 854 (step S423), and finishes the process. If the determination in step S414 is "no", the process is finished without performing the above-described operations.

Detection of an irregularity in the diameter of the first roller 110 in step S204 and step S210 of FIG. 7 is performed as follows.

First, the determination unit 855 obtains the updated first-roller radius data r1_new[i] (see the lower part of FIG. 15) from the first-roller radius calculator 853. Next, the determination unit 855 determines whether or not the updated first-roller radius data r1_new[i] is deviated from a design value (for example, 15.0 mm) of the radius of the first roller 110 beyond a predetermined range (for example, 15.0±0.3 mm). If at least a part of the updated first-roller radius data r1_new [i] is deviated from the design value of the radius of the first roller 110 beyond the predetermined range, the determination unit 855 determines that an irregularity in the diameter has occurred in the first roller 110, and causes the UI 90 to perform fault notification. The determination unit 855 calculates the perimeter of the first peripheral surface portion 113 of the first roller 110 by using the updated first-roller radius data r1_new[i] (see the lower part of FIG. 15), determines whether or not the calculated perimeter is smaller than a predetermined lower limit (for example 91.0 mm) of the design value of the perimeter of the first roller 110 (about 92.25 mm if the design value of the radius of the first roller 110 is 15.0 mm). If the calculated perimeter of the first roller 110 is smaller than the lower limit, the determination unit 855 determines that an irregularity in the diameter has occurred in the first roller 110, and causes the UI 90 to perform fault notification. In this example, a first rotating member correction value is obtained on the basis of the first-roller radius data r1_new[i], and a second rotating member correction value is obtained on the basis of the second-roller diameter/slit correction data r2[i].

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet measuring apparatus comprising:

a first rotating member that includes a first peripheral surface portion that contacts a transported sheet, the first rotating member being rotated as a result of transporting of the sheet;

a second rotating member that includes a second peripheral surface portion that is made of a material different from a material of the first peripheral surface portion, the second peripheral surface contacting the first peripheral surface portion and not contacting the sheet, the second rotating member rotating as the first rotating member rotates;

a first rotation amount detecting unit that detects a first rotation amount that is a rotation amount of the first rotating member;

a second rotation amount detecting unit that detects a second rotation amount that is a rotation amount of the second rotating member, the second rotation amount being used for a calculation related to the transported sheet; and a fault detecting unit that detects a fault that has occurred in the first rotating member on the basis of the first rotation amount and the second rotation amount.

2. The sheet measuring apparatus according to claim 1, further comprising:

a radius distribution calculating unit that calculates a radius distribution of the first rotating member in a circumferential direction on the basis of the first rotation amount and the second rotation amount, wherein the fault detecting unit detects a fault that has occurred in the first rotating member on the basis of the radius distribution calculated by the radius distribution calculating unit.

3. The sheet measuring apparatus according to claim 2, wherein the fault detecting unit obtains a reference radius distribution of the first rotating member in the circumferential direction and detects a fault that has occurred in the first rotating member by using the radius distribution and the reference radius distribution.

4. The sheet measuring apparatus according to claim 2, wherein the radius distribution calculating unit obtains a second rotating member correction value for correcting an error that is superposed on the second rotation amount due to the second rotating member and the second rotation amount detecting unit, and the radius distribution calculating unit calculates the radius distribution on the basis of the first rotation amount and the second rotation amount that has been corrected on the basis of the second rotating member correction value.

5. The sheet measuring apparatus according to claim 2, further comprising:

an end detecting unit that detects a leading end and a trailing end of the transported sheet in a transport direction; and a sheet calculating unit that calculates a length of the sheet in the transport direction on the basis of the second rotation amount and a detection result obtained by the end detecting unit.

6. The sheet measuring apparatus according to claim 5, further comprising:

a temperature detecting unit that detects a temperature of the second rotating member, wherein the sheet calculating unit corrects the calculation related to the sheet on the basis of a detection result obtained by the temperature detecting unit.

7. The sheet measuring apparatus according to claim 2, wherein a material of the second peripheral surface portion of the second rotating member has a thermal expansion coefficient that is lower than a thermal expansion coefficient of a material of the first peripheral surface portion of the first rotating member.

8. The sheet measuring apparatus according to claim 2, wherein a material of the second peripheral surface portion of the second rotating member is a metal, and a material of the first peripheral surface portion of the first rotating member is an elastic material.

9. The sheet measuring apparatus according to claim 5, wherein the sheet calculating unit obtains a first rotating member correction value for correcting an error that is superposed on the second rotation amount due to the radius distribution of the first rotating member in the circumferential direction, and performs the calculation related to the transported sheet by using the second rotation amount and the first rotating member correction value, and wherein the radius distribution calculating unit further includes an updating unit that calculates a new radius distribution of the first rotating member in the circumferential direction and updates the first rotating member correction value to a new first rotating member correction value that is obtained on the basis of the new radius distribution.

10. An image forming apparatus comprising:

a first rotating member that includes a first peripheral surface portion that contacts a transported sheet, the first rotating member being rotated as a result of transporting of the sheet;

a second rotating member that includes a second peripheral surface portion that is made of a material different from a material of the first peripheral surface portion, the second peripheral surface contacting the first peripheral surface portion and not contacting the sheet, the second rotating member rotating as the first rotating member rotates;

a first rotation amount detecting unit that detects a first rotation amount that is a rotation amount of the first rotating member;

a second rotation amount detecting unit that detects a second rotation amount that is a rotation amount of the second rotating member, the second rotation amount being used for a calculation related to the transported sheet;

an image forming unit that forms an image on the sheet on the basis of a result of the calculation related to the transported sheet; and a fault detecting unit that detects a fault that has occurred in the first rotating member on the basis of the first rotation amount and the second rotation amount.

11. The image forming apparatus according to claim 10, further comprising:

a radius distribution calculating unit that calculates a radius distribution of the first rotating member in a circumferential direction of the first rotating member on the basis of the first rotation amount and the second rotation amount, wherein the fault detecting unit detects a fault that has occurred in the first rotating member on the basis of the radius distribution calculated by the radius distribution calculating unit.

12. The image forming apparatus according to claim 11, wherein the fault detecting unit obtains a reference radius distribution of the first rotating member in the circumferential direction and detects a fault that has occurred in the first rotating member by using the radius distribution and the reference radius distribution.

13. The image forming apparatus according to claim 11, wherein the radius distribution calculating unit obtains a second rotating member correction value for correcting an error that is superposed on the second rotation amount due to the second rotating member and the second rotation amount detecting unit, and the radius distribution calculating unit calculates the radius distribution on the basis of the first rotation amount and the second rotation amount that has been corrected on the basis of the second rotating member correction value.

14. The image forming apparatus according to claim 11, further comprising:

an end detecting unit that detects a leading end and a trailing end of the transported sheet in a transport direction; and a sheet calculating unit that calculates a length of the sheet in the transport direction on the basis of the second rotation amount and a detection result obtained by the end detecting unit.

15. The image forming apparatus according to claim 14, further comprising:

a temperature detecting unit that detects a temperature of the second rotating member, wherein the sheet calculating unit corrects the calculation related to the sheet on the basis of a detection result obtained by the temperature detecting unit.

16. The image forming apparatus according to claim 14, wherein the image forming unit forms an image on a first side of the sheet and forms an image on a second side of the sheet, the second side being opposite to the first side, and adjusts an image forming condition on the basis of the calculation result obtained by the sheet calculating unit when forming the image on the second side of the sheet.

* * * * *